US006796554B2

(12) United States Patent
Trovinger

(10) Patent No.: US 6,796,554 B2
(45) Date of Patent: Sep. 28, 2004

(54) APPARATUS FOR STACKING FOLDED PAPER SHEETS

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 109 days.

(21) Appl. No.: 10/242,436

(22) Filed: Sep. 13, 2002

(65) Prior Publication Data

US 2004/0052613 A1 Mar. 18, 2004

(51) Int. Cl.[7] ..... B42C 19/04

(52) U.S. Cl. ..... 270/52.26; 270/32; 270/37; 412/33; 493/405

(58) Field of Search ..... 270/52.26, 52.27, 270/52.28, 52.29, 32, 37; 412/33, 18; 493/405, 416, 204, 196

(56) References Cited

U.S. PATENT DOCUMENTS

| | | | | |
|---|---|---|---|---|
| 1,030,891 A | * | 7/1912 | Kast | 270/52.26 |
| 3,572,684 A | * | 3/1971 | Gorig | 270/52.28 |
| 4,053,150 A | | 10/1977 | Lane | |
| 4,226,410 A | | 10/1980 | McIntosh, Sr. et al. | |
| 4,595,187 A | | 6/1986 | Bober | |
| 4,891,681 A | | 1/1990 | Fiske et al. | |
| 4,989,850 A | * | 2/1991 | Weller | 270/1.02 |
| 5,028,193 A | | 7/1991 | Misicka | |
| 5,087,163 A | | 2/1992 | Erdbories et al. | |
| 5,346,350 A | | 9/1994 | Luhman et al. | |
| 5,377,965 A | * | 1/1995 | Mandel et al. | 270/37 |
| 5,452,920 A | | 9/1995 | Parker | |
| 5,465,213 A | | 11/1995 | Ross | |
| 5,615,871 A | * | 4/1997 | Kleinhen | 270/45 |
| 5,803,891 A | | 9/1998 | Haan et al. | |
| 5,810,345 A | * | 9/1998 | Lehmann et al. | 270/52.26 |
| 6,099,225 A | | 8/2000 | Allen et al. | |
| 6,120,427 A | | 9/2000 | Haan et al. | |
| 6,193,458 B1 | | 2/2001 | Marsh | |
| 6,363,851 B1 | | 4/2002 | Gerhard et al. | |
| 6,554,267 B2 | | 4/2003 | Trovinger | |
| 6,708,967 B1 | | 3/2004 | Trovinger et al. | |
| 2003/0161704 A1 | | 8/2003 | Trovinger | |
| 2003/0161705 A1 | | 8/2003 | Trovinger | |
| 2003/0162644 A1 | | 8/2003 | Trovinger | |
| 2004/0041326 A1 | | 3/2004 | Trovinger | |

FOREIGN PATENT DOCUMENTS

| | | |
|---|---|---|
| GB | 1018160 | 1/1966 |
| GB | 1094401 | 12/1967 |
| WO | 00/18583 | 4/2000 |

* cited by examiner

*Primary Examiner*—Patrick Mackey

(57) ABSTRACT

An apparatus for stacking a folded paper sheet includes a collecting device having a first side and a second side, a first sheet drive assembly including a first sheet contacting component, and a second sheet drive assembly including a second sheet contacting component. The first sheet drive assembly is located on the first side of the collecting device and is operable to move between a sheet receiving position and a sheet discharging position. The second sheet drive assembly is located on the second side of the collecting device and the second sheet contacting component translates to pinch the sheet on the second side of the collecting device. The collecting device is stationary with respect to at least one of a paper path, the first sheet drive assembly and the second sheet drive assembly during a sheet collecting operation. A booklet making system having a paper path, a paper folding apparatus, and an apparatus for stacking a folded paper sheet during a sheet stacking operation and a method for handling folded paper sheets is also provided.

70 Claims, 11 Drawing Sheets

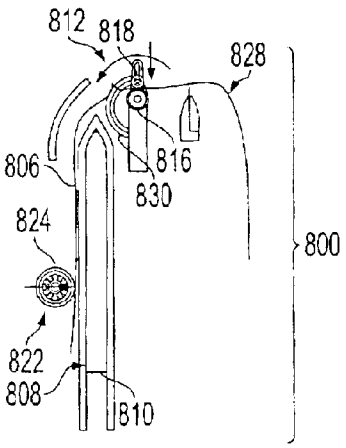
FIG. 8a
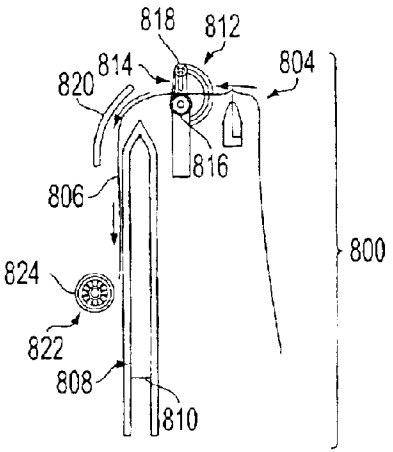
FIG. 8b
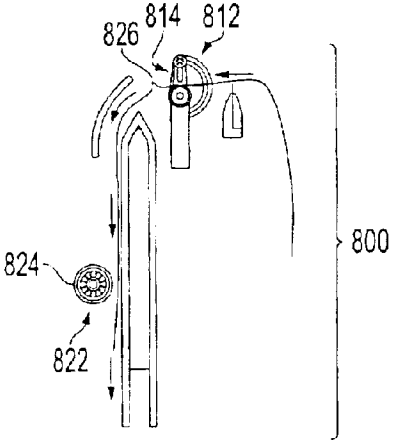
FIG. 8c
FIG. 8d
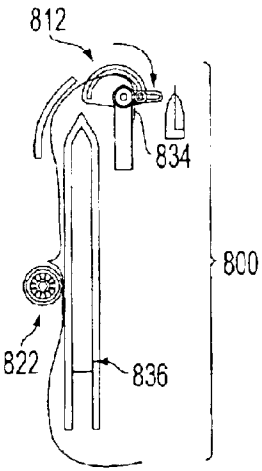
FIG. 8f
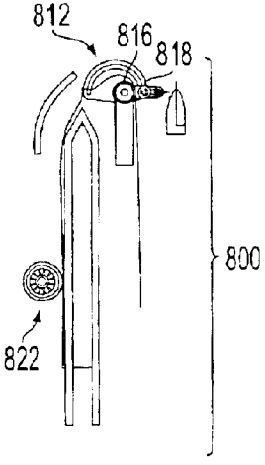
FIG. 8g
FIG. 8h
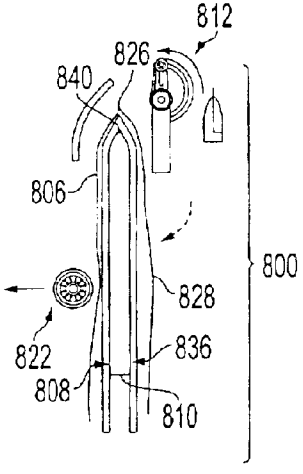
FIG. 8i
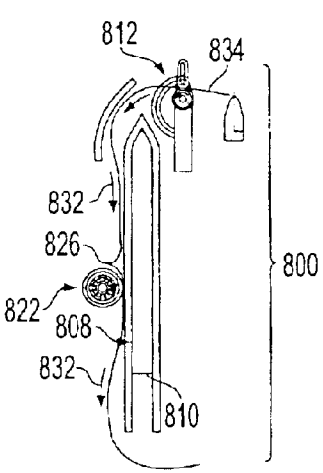
FIG. 8e

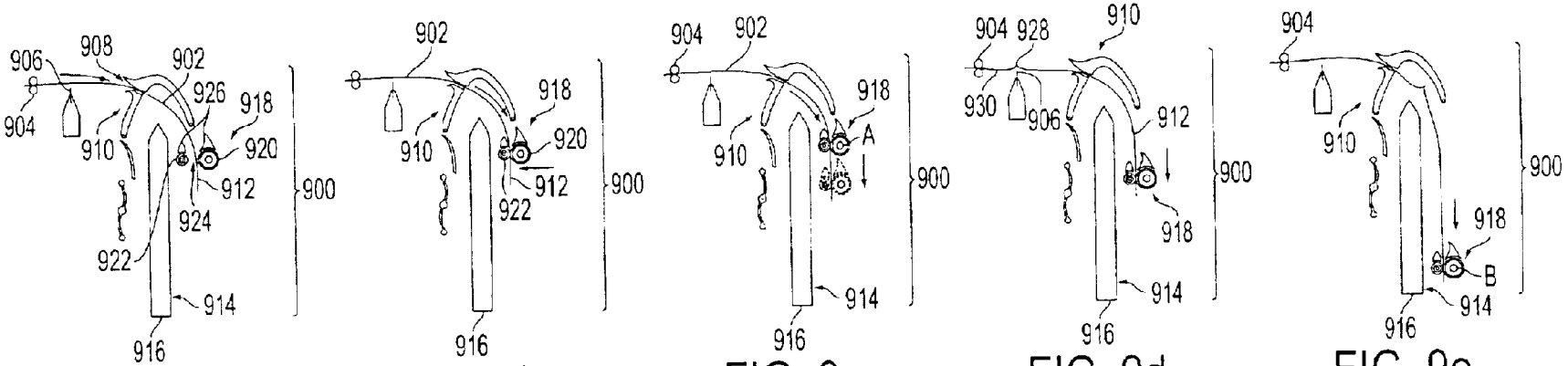
FIG. 9a
FIG. 9b
FIG. 9c
FIG. 9d
FIG. 9e
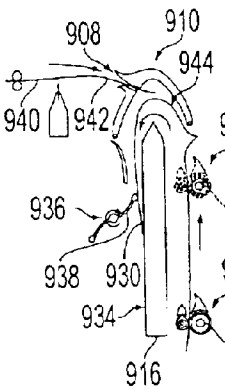
FIG. 9f
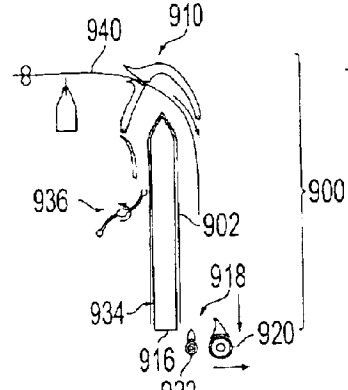
FIG. 9g
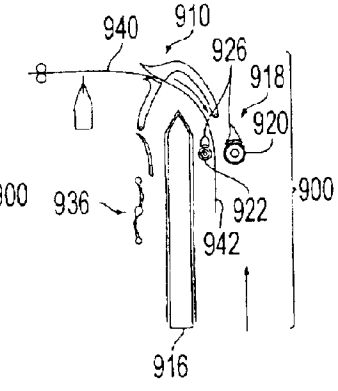
FIG. 9h
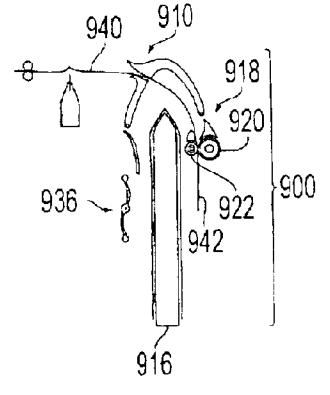
FIG. 9i
FIG. 9j

APPARATUS FOR STACKING FOLDED PAPER SHEETS

BACKGROUND

1. Field of Invention

The present invention relates to an apparatus for stacking folded paper sheets in which the collecting device is stationary during the sheet collecting operation.

2. Background Information

Duplex printed sheets are often bound into finished documents, such as booklets, by a paper-handling accessory. Machines perform finishing operations, such as binding, folding, trimming, saddle stapling, and hole drilling. The handling of sheets of paper for booklet making includes additional manipulating operations such as collecting and positioning sheets of paper. Booklet making systems can operate to collect folded sheets on a workpiece by rotating the workpiece to place the two portions of the folded sheet on opposite sides of the workpiece.

For example, a system for finishing printed sheets into booklets is described in U.S. Pat. No. 6,099,225 (Allen et al.), hereby incorporated by reference in its entirety. The '225 patent discloses an inverted V-shaped workpiece for collecting folded booklet sheets.

A system for making saddle-stitched booklets on a sheet-wise basis is disclosed in PCT No. WO 00/18583 (Trovinger et al.), hereby incorporated by reference in its entirety. In this system, folded booklet sheets are forwarded from a folding device to a reciprocating saddle with the use of a secondary drive system. The reciprocating saddle is described as permitting a trailing side of a folded sheet to be transported onto the backside of the saddle.

U.S. patent application Ser. No. 10/084,459, filed Feb. 28, 2002, entitled "SYSTEM FOR HANDLING FOLDED SHEET MATERIAL" (Attorney Docket No. 10015158-1) (Trovinger), hereby incorporated by reference in its entirety, discloses a system for moving folded sheets to a collecting device and clamping the folded sheets against the collecting device. The folded sheets are moved to the collecting device in a non-linear path, where each sheet is delivered to the collecting device such that a leading side and a trailing side of the sheet are respectively delivered to different sides of the collecting device.

U.S. patent application Ser. No. 10/084,460, filed Feb. 28, 2002, entitled "BOOKLET MAKER" (Attorney Docket No. 10014012-1) (Trovinger), hereby incorporated by reference in its entirety, discloses a booklet maker including a pivotable collecting device. The pivotable collecting device has two supporting sides formed with a saddle shape, and a rotatable transferring device including a displaceable clamping component. The transferring device delivers a folded sheet material to the collecting device along a non-linear path, and the collecting device pivots to receive the folded sheet material from the transferring device such that different portions of the folded sheet material are supported by different sides of the two supporting sides of the collecting device.

U.S. patent application Ser. No. 10/084,462, filed Feb. 28, 2002, entitled "PIVOTABLE COLLECTING DEVICE" (Attorney Docket No. 10015154-1) (Trovinger), hereby incorporated by reference in its entirety, also discloses a pivotable collecting device for handling a folded sheet material.

SUMMARY

The present invention is directed to an apparatus for stacking a folded paper sheet. In an exemplary embodiment, an apparatus for stacking a folded paper sheet comprises a collecting device having a first side and a second side, a first sheet drive assembly including a first sheet contacting component, the first sheet drive assembly located on the first side of the collecting device and operable to move between a sheet receiving position and a sheet discharging position, and a second sheet drive assembly including a second sheet contacting component, the second sheet drive assembly located on the second side of the collecting device and the second sheet contacting component translates to pinch the sheet on the second side of the collecting device. The collecting device is stationary with respect to at least one of a paper path, the first sheet drive assembly and the second sheet drive assembly during a sheet collecting operation.

A booklet making system according to exemplary embodiments comprises a paper path, a paper folding apparatus, and an apparatus for stacking a folded paper sheet during a sheet stacking operation. The apparatus includes a collecting device having a first side and a second side, a first sheet drive assembly including a first sheet contacting component, located on the first side of the collecting device and operable to move between a sheet receiving position and a sheet discharging position, and a second sheet drive assembly located on the second side of the collecting device including a second sheet contacting component translatable to pinch the sheet on the second side of the collecting device. The collecting device is stationary with respect to at least one of the paper path, the first sheet contacting component and the second sheet contacting component during a sheet collecting operation.

In an exemplary embodiment, a folded sheet handling apparatus can include a collecting device having a first side and a second side, means for guiding a folded sheet from a paper path to the collecting device such that a leading portion of the folded sheet is positioned on the collecting device, means for moving a folded sheet along at least one of the first side and the second side of the collecting device, and means for positioning a trailing edge portion of the folded sheet on the collecting device. The collecting device is stationary with respect to the paper path during a sheet collecting operation.

An exemplary method for handling folded paper sheets, comprises guiding a first portion of a folded paper sheet to a first side of a collecting device along a paper path which includes a first sheet contacting component of a first sheet drive assembly, contacting the first portion of the folded paper sheet with a second sheet contacting component of a second sheet drive assembly, contacting a second portion of the folded paper sheet with the first sheet contacting component of the first sheet drive assembly, rotating or translating at least one of the first sheet contacting component and the second sheet contacting component in a sheet advancing direction to advance the first portion of the folded paper sheet along the first side of the collecting device, repositioning the first sheet drive assembly to guide the second portion of the folded paper sheet to a second side of the collecting device, and rotating or translating at least one of the first sheet contacting component and the second sheet contacting component in a sheet reversing direction to position the second portion of the folded paper sheet along the second side of the collecting device.

Another exemplary method for handling folded paper sheets comprises guiding a leading portion of a first folded paper sheet to a second side of a collecting device, guiding the leading portion of the first folded paper sheet between a sheet contacting component and the second side of the collecting device, positioning a fold in the first folded paper sheet over an edge of the collecting device, moving the sheet contacting component to apply a force against the second side of the collecting device to hold the leading portion of the first folded paper sheet stationary, and sweeping at least one sweep element from a first position on a first side of a paper path, through the paper path, to a second position so as to position a trailing portion of the first folded sheet along the first side of the collecting device.

BRIEF DESCRIPTION OF THE DRAWINGS

Objects and advantages of the invention will become apparent from the following detailed description of preferred embodiments in connection with the accompanying drawings, in which like numerals designate like elements and in which:

FIGS. 8*a*–8*i* show sequential side views of the apparatus of FIG. 2 during stacking of folded paper sheet in an exemplary sheet collecting operation.

FIGS. 9*a*–9*j* show sequential side views of the apparatus of FIG. 4 during stacking of folded paper sheet in an exemplary sheet collecting operation.

DETAILED DESCRIPTION OF THE PREFERRED EMBODIMENTS

Figure 1:
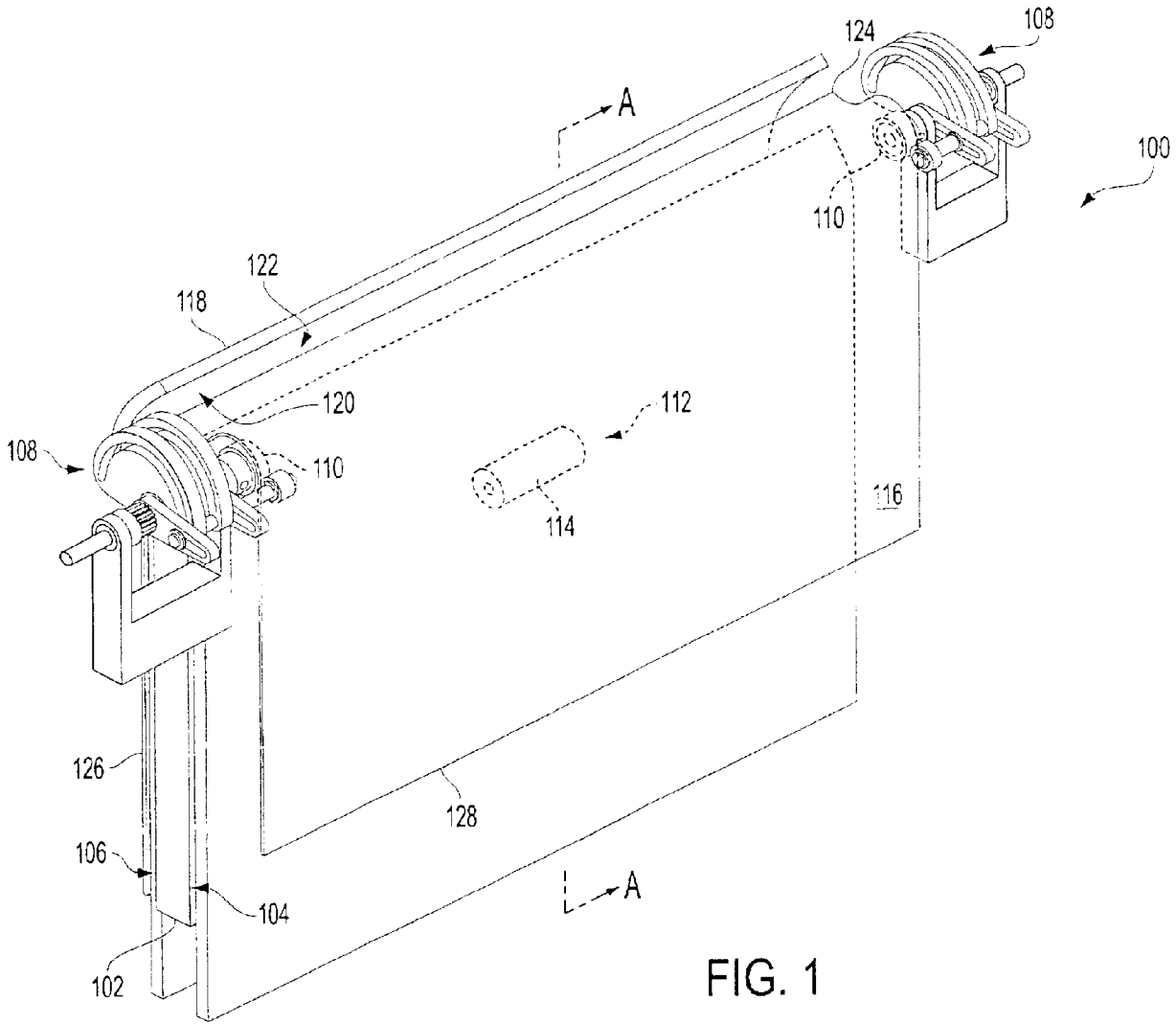
FIG. 1 shows a perspective view of an exemplary embodiment of an apparatus for stacking folded paper sheets during a sheet collecting operation.

FIG. 1 shows a perspective view of an exemplary embodiment of an apparatus for stacking a folded paper sheet during a sheet collecting operation. The FIG. 1 apparatus 100 includes a collecting device 102 having a first side 104 and a second side 106, a first sheet drive assembly 108 including a first sheet contacting component 110, and a second sheet drive assembly 112 including a second sheet contacting component 114. The first sheet drive assembly 108 is located on the first side 104 of the collecting device 102 and is operable to move between a sheet receiving position and a sheet discharging position. The second sheet drive assembly 112 is located on the second side 106 of the collecting device 102 and the second sheet contacting component 114 translates to pinch the sheet 116 on the second side 106 of the collecting device 102. The collecting device 102 of the apparatus 100 is stationary with respect to at least one of a paper path, the first sheet drive assembly 108, and the second sheet drive assembly 112 during a sheet collecting operation.

The first sheet contacting component can be any suitable component that can guide, contact, advance or reverse, and/or otherwise manipulate the position of the folded paper sheet within the apparatus and with respect to the collecting device. In an exemplary embodiment, the first sheet contacting component is a driven rotatable element operably connected to a first drive mechanism to rotate the driven rotatable element. Likewise, the second sheet drive contacting component can be any suitable component that can guide, contact, advance or reverse, and/or otherwise manipulate the position of the folded paper sheet within the apparatus and with respect to the collecting device. In an exemplary embodiment, the second sheet contacting component is a driven rotatable element operably connected to a second drive mechanism to rotate about an axis.

As referenced herein, a drive mechanism is any device capable of providing some motive force which can, for example, be imparted to a sheet contacting component, such as a roller, a tire, a linear or curvilinear flapper bar, or a redirecting arm or surface, including but not limited to an electric, pneumatic or hydraulic motor for driving a shaft of a contacting component. Further, a drive mechanism can have multiple such devices.

A stationary redirecting element 118 can be included in the apparatus 100. In an exemplary embodiment, the stationary redirecting element 118 has a first surface 120 facing at least one of the first and second sides 104,106 of the collecting device 102. The first surface 120 is offset a distance from the collecting device to define a folded paper channel 122. The redirecting element 118 deflects the paper path. For example, the folded paper sheet can be advanced along the paper path such that a leading portion is advanced across the collecting device. The leading portion is then deflected by the redirecting element such that the folded paper sheet advances down the first or second side of the collecting device. In another example, the redirecting element deflects the paper path approximately ninety degrees (90°), although any desired angle from 0° to 180°, or greater, can be used.

A fold 124 separates the sheet 116 into a leading portion 126 and a trailing portion 128. Folded paper sheet can have been previously provided with the fold 124, by, for example, the operation of a fold device located upstream in the paper path from the apparatus 100 for stacking a folded paper sheet. Alternatively, the fold device can be integrated into the apparatus 100 for stacking folded paper sheet or can be positioned at any other suitable location along the paper path.

The collecting device 102 can be any suitable collecting device to stack folded paper sheets such that a leading portion of the folded paper sheet and a trailing portion of the folded paper sheet are on different sides of the collecting device. For example, the leading portion of the folded paper sheet can be on the first side of the collecting device and the trailing portion can be on the second side of the collecting device, or vice versa. Further, subsequently stacked folded paper sheets can be positioned on the collecting device with the leading portion and the trailing portion in registry with the previously stacked folded paper sheets. In an exemplary embodiment, the collecting device is saddle shaped, e.g., the collecting device has one edge separating the first side from the second side where the edge is tapered to correspond to the inner folded surface of a folded paper sheet.

Figure 2:
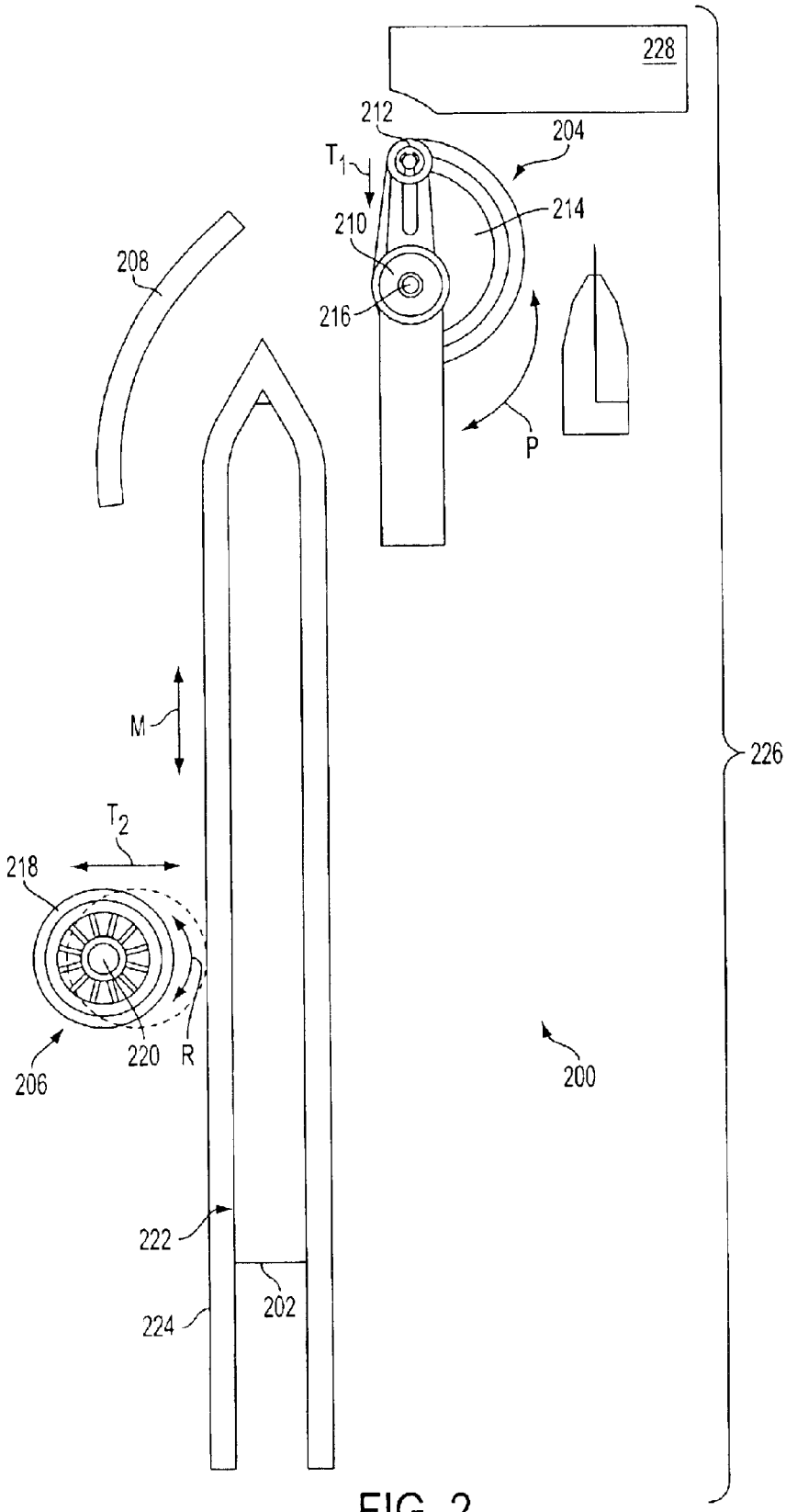
FIG. 2 is a cross sectional view along A—A of the FIG. 1 apparatus.

FIG. 2 is a cross-sectional view along A—A of the FIG. 1 apparatus. The exemplary apparatus 200 includes a collecting device 202, a first sheet drive assembly 204, and a second sheet drive assembly 206. A stationary redirecting element 208 is also shown.

In the exemplary embodiment shown in FIG. 2, the first sheet contacting component is a driven rotatable element 210 operably connected to a first drive mechanism. The first sheet drive assembly 204 can comprise the driven rotatable element 210, a freely rotatable element 212, and a housing 214. The driven rotatable element 210 and the freely rotatable element 212 are mounted on the housing 214 and the freely rotatable element 212 can translate ($T_1$) to an engaged position to apply force to the driven rotatable element 210. For example, the driven rotatable element 210 can be a drive tire or roller and the freely rotatable element 212, shown in the exemplary embodiment of FIG. 2 as a pinch tire or roller, can have an axis of rotation that can be translated toward the axis of rotation of the driven rotatable element 210. The housing 214 can pivot (P) about a pivot axis 216 from the sheet receiving position to the sheet discharging position.

The second sheet drive assembly 206 includes a second sheet contacting component. In the exemplary embodiment shown in FIG. 2, the second sheet contacting component is a driven rotatable element 218 operably connected to a second drive mechanism to rotate about an axis 220. The driven rotatable element 218 can move relative to the second side 222 of the collecting device 202. For example, the driven rotatable element 218 can translate ($T_2$) perpendicularly to the paper path to apply force to the second side 222 of the collecting device 202. In another example, the driven rotatable element 218 can move from an offset position to pinch the folded paper sheet 224 on the second side 222 of the collecting device 202. The second sheet drive assembly 206 can then provide a motive force, e.g., rotation (R), to move (M) the folded paper sheet 224 in an advancing direction or a reversing direction along the paper path. This motive force can be coordinated with the motive force provided by the first sheet drive assembly 204. For example, the first sheet contacting component, e.g., the driven rotatable element 210, 216, of each of the first and second sheet drive assemblies 204, 206 can operate at the same time and/or at the same rotational speed and/or at proportional speeds to simultaneously move the folded paper sheet 224.

Figure 3:
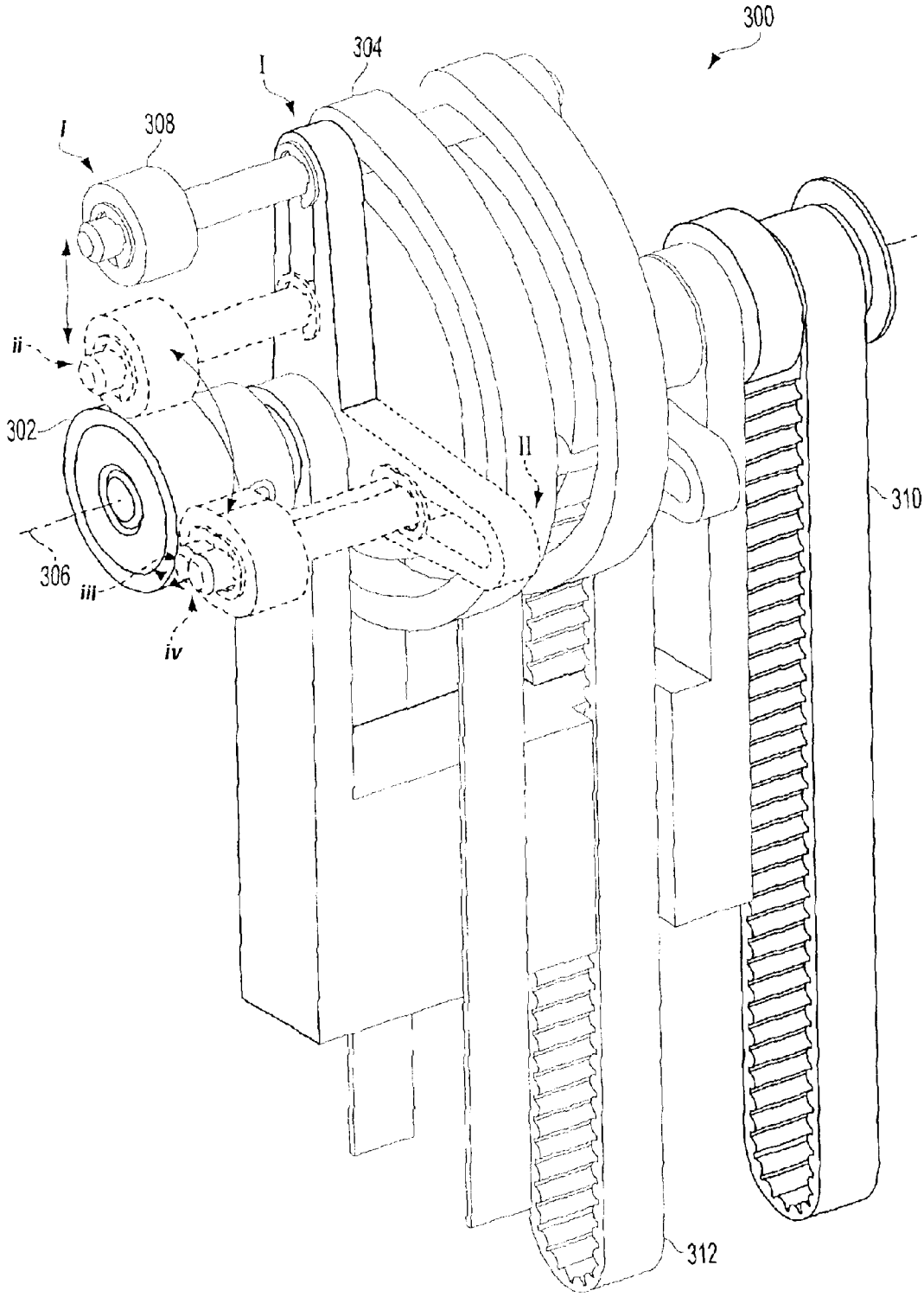
FIG. 3 shows a perspective view of a detail of the first sheet drive assembly of the FIG. 3 embodiment

FIG. 3 shows a detail perspective view of the first sheet drive assembly 300 of FIG. 2. In the exemplary embodiment, the driven rotatable element 302 is mounted in the housing 304 coaxially with a pivot axis 306 of the housing 304. However, the driven rotatable element 302 can be mounted at any suitable location in the housing 304. For example, one or both of the freely rotatable element 308 and the driven rotatable element 302 can be mounted in the housing 304 to pivot on or about the pivot axis 306 when the housing 304 pivots. In the FIG. 3 embodiment, the housing 304 is represented by an eccentrically mounted cam.

A first drive mechanism (not shown) can rotate the driven rotatable element 302. The driven rotatable element 302 can be operatively connected to the first drive mechanism by any suitable means. For example and as shown in FIG. 3, the first drive mechanism is operatively connected to the axis 306 of the driven rotatable element 302 via a belt 310. Alternatively, the operative connection can be a direct drive, indirect drive, or other coupling system. As shown, the housing 304 and the driven rotatable element 302 share a common axis 306, however, this is not required and the housing 304 and the driven rotatable element 306 can have independent axes.

The freely rotatable element 308 can translate from a sheet receiving position to an engaged position to apply force to the driven rotatable element 302. For example, the freely rotatable element 308 can reposition from a position spaced apart from the driven rotatable element 302 to a position contacting the driven rotatable element 302, indicated respectively by i and ii in FIG. 3. The translation of the freely rotatable element 308 can be by a separate drive system or can be by integration with one of the first and second drive mechanisms or with the movement of the housing 304 around the pivot axis 306, e.g., can be mechanically integrated with the eccentrically mounted cam as the cam pivots.

The freely rotatable element 308 in the engaged position can then move to a sheet discharging position. As shown in FIG. 3, movement from the engaged position to the rotated engaged position, represented respectively by ii and iii, can be coincident with the movement or rotation of the housing 304. For example, a second belt 312 can be operatively connected to the housing 304 for pivoting the housing 304 on the pivot axis 306. Two positions of the housing 304 are shown, the sheet receiving position and the sheet discharging position, indicated by I and II, respectively. The pivot system can be a separate drive mechanism or can be a shared or a coordinated drive mechanism with, for example, the first drive mechanism, other first sheet drive assemblies or other paper handling apparatus. As the housing 304 pivots about the pivot axis 306, the freely rotatable element 308 also pivots about the pivot axis 306 while also maintaining engagement with the driven rotatable element 302. Thus, for example, the freely rotatable element 308 and the driven rotatable element 302 can pinch a folded paper sheet within the first sheet drive assembly during the movement of the housing from a sheet receiving position I to a sheet discharging position II. When the housing 304 is in the sheet discharging position II, the freely rotatable element 308 can further translate from the rotated engaged position iii away from the driven rotatable element 302 to a sheet discharge position iv where the folded paper sheet is no longer held between the freely rotatable element 308 and the driven rotatable element 302.

The sheet receiving position of the first sheet drive assembly is located a first distance from the first side of the collecting device and the sheet discharging position is located a second distance from the first side of the collecting device. In the sheet receiving position, the first sheet drive assembly guides a leading portion of the folded sheet to the second side of the collecting device. In the sheet discharging position, the first sheet drive assembly guides the trailing portion of the folded sheet to the first side of the collecting device.

As shown in the exemplary embodiment of FIG. 3, the first and second distances can have a coaxial relationship. In the first sheet receiving position, the first sheet drive assembly is oriented on the pivot axis and the freely rotatable element is spaced apart from the driven rotatable element, thus providing a paper path for the leading edge of the folded paper sheet. The freely rotatable element translates in a direction toward the driven rotatable element to the engaged position to apply force to the driven rotatable element, thereby pinching the sheet within the first sheet drive assembly. For example, the first sheet contacting component can contact an edge, a surface, or the edge of a surface of the folded sheet. The first sheet drive assembly can then rotate about the pivot axis to a sheet discharging position. For example, in the discharge position the trailing portion of the folded paper sheet can be oriented parallel to the first side of the collecting device. Although described as parallel, any orientation that orients the trailing portion of the folded paper sheet to advance along the first side of the collecting device can be used. The first sheet drive assembly then guides the trailing portion of the folded sheet to the first side of the collecting device by, for example, providing a motive force to move the folded sheet in an advancing direction or a reversing direction along the paper path.

In an exemplary embodiment, an apparatus for stacking a folded paper sheet during a sheet collecting operation can comprise a plurality of first sheet drive assemblies on the first side of the collecting device. For example, and as shown in the exemplary embodiment of FIG. 1, a plurality of first sheet drive assemblies 108 can include one first sheet drive assembly on a first edge of the folded sheet and one first sheet drive assembly on a second edge of the folded sheet. One of the first sheet drive assemblies on a first edge of the folded sheet can be operatively connected to move relative to one of the first sheet drive assemblies on a second edge of the folded sheet. For example, the operative connection can be via a linkage. The linkage can comprise a gear rack and a gear operated by a translational mechanism to provide relative movement of the first sheet drive assemblies away from the paper path. Alternatively, the translational movement of the first sheet drive assemblies can be coordinated by any suitable means, such as a controller operating independent translation devices, hydraulic couplings including interlocks, and so forth.

Figure 4:
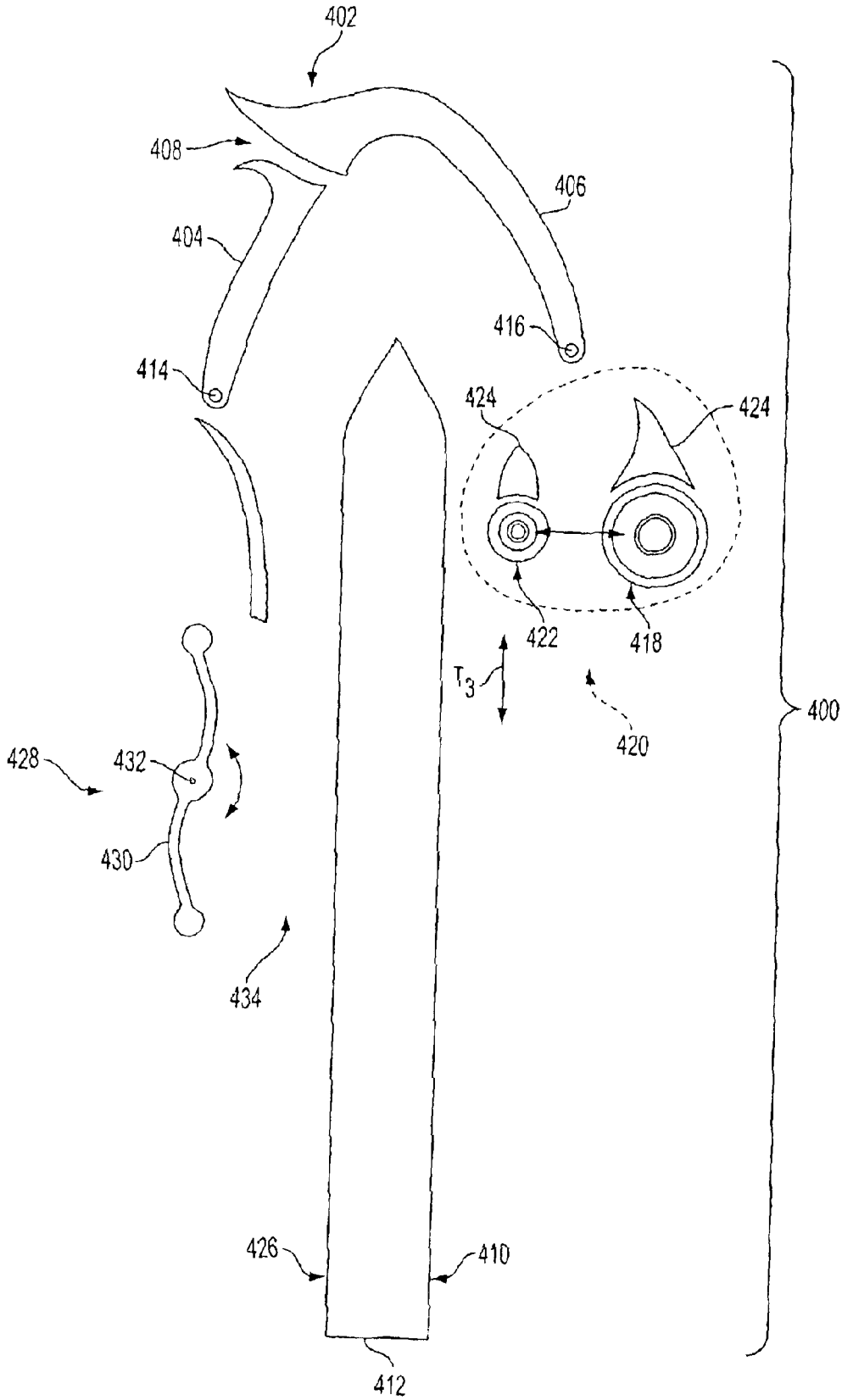
FIG. 4 shows an exemplary embodiment of an apparatus for stacking folded paper sheets during a sheet collecting operation with a paper handling entrance assembly.

FIG. 4 shows an exemplary embodiment of an apparatus 400 for stacking a folded paper sheet during a sheet collecting operation. In the exemplary embodiment, the apparatus 400 has a paper handling entrance assembly 402 including a first paper handling chute 404 and a second paper handling chute 406. The first paper handling chute 404 is spaced apart from the second paper handling chute 406 to form a slot 408 for receiving the folded paper sheet. The slot 408 is oriented to guide the folded paper sheet to the first side 410 of the collecting device 412. The first paper handling chute 404 and the second paper handling chute 406 can pivot away from each other, each having a pivot point 414, 416 distal from the slot 408.

In the exemplary embodiment shown in FIG. 4, the first sheet contacting component is a driven rotatable element 418 operably connected to a first drive mechanism. The first sheet drive assembly 420 can include the driven rotatable element 418 and an opposing sheet contacting component 422. The opposing sheet contacting component 422 can be a freely rotatable element, shown in the exemplary embodiment of FIG. 4 as a pinch tire. The driven rotatable element 418 and the opposing contacting component 422 can be independently mounted or commonly mounted on, for example, a housing and the driven rotatable element 418 can be translatable to an engaged position to apply force to the opposing sheet contacting component 422, thereby pinching the leading portion of the folded paper sheet within the first sheet drive assembly 420. For example, the driven rotatable element 418 can be a drive tire or roller whose axis of rotation can be translated toward the axis of rotation of the freely rotatable element.

The first sheet drive assembly 420 can also have guide elements 424 associated with the driven rotatable element 418 and the opposing contacting sheet component 422. For example and as shown in FIG. 4, an exemplary embodiment of guide elements 424 can have a taper from a base proximal to the sheet contacting components to a point distal from the sheet contacting components. The taper can provide a guiding or funneling function whereby the leading portion of the folded paper sheet is guided between the first sheet contacting component and the opposing contacting component, e.g., between the driven rotatable element and the freely rotatable element, as the folded paper sheet is received by the first sheet drive assembly.

In the exemplary embodiment shown in FIG. 4, the first sheet drive assembly 420 is translatable ($T_3$) parallel to the first side 410 of the collecting device 412 to position the folded paper sheet on the collecting device 412. For example, after the rotatable elements of the first sheet drive assembly 420 have engaged to pinch the leading portion of the folded paper sheet, the first sheet drive assembly 420 can translate parallel to the first side 410 of the collecting device 412 and away from the paper handling entrance assembly 402 such that additional portions of the folded paper sheet are brought through the slot 408 of the paper handling entrance assembly 402. In other words, the first sheet drive assembly 420 is translatable to advance the folded paper sheet along the paper path and into the apparatus 400. Similarly, the first sheet drive assembly 420 can reverse its translational direction and thereby move the folded paper sheet in the reverse direction along the paper path. During this reverse movement, the trailing portion of the folded paper sheet is guided to the second side 426 of the collecting device 412 between the second sheet drive assembly 428 and the second side 426 of the collecting device 412.

In the exemplary embodiment shown in FIG. 4, the second sheet drive assembly 428 has a second sheet contacting component 430 that is a driven rotatable element operably connected to a second drive mechanism. The second drive mechanism rotates the second sheet contacting component 430 about an axis 432. In the FIG. 4 embodiment, the driven rotatable element is represented by a curvilinear paddle bar.

In a sheet receiving position, the second sheet contacting component 430 is spaced apart from the second side 426 of the collecting device 412. Where the second sheet contacting component 430 is a curvilinear flapper bar, the arms of the flapper bar are spaced apart from the second side of the collecting device to provide a channel 434 in which the trailing portion of the folded paper sheet can be placed. The channel 434 is positioned between the second sheet drive assembly 428 and the second side 426 of the collecting device 412.

In the sheet discharging position, the second sheet drive assembly 428 rotates and the second sheet contacting component 430 contacts the trailing portion of the folded paper sheet to the second side 426 of the collecting device 412. Where the second sheet contacting component 430 is a curvilinear flapper bar, the ends of the arms and/or the arms can be compliant and flexible, such that the flapper bar arms provide a motive force to the folded paper sheet during the rotation.

The first sheet drive assembly and the second sheet drive assembly can be positioned on either side of the collecting device with respect to the receiving point of the folded paper sheet along the paper path. For example, and as shown in FIGS. 1 and 2, the first sheet drive assembly can be located on the receiving side of the collecting device with respect to the paper path. Alternatively, and as shown in FIG. 4, the second sheet drive assembly can be located on the receiving side of the collecting device with respect to the paper path. In other words, either side of the collecting device can be designated the first side and the second side.

Figure 5:
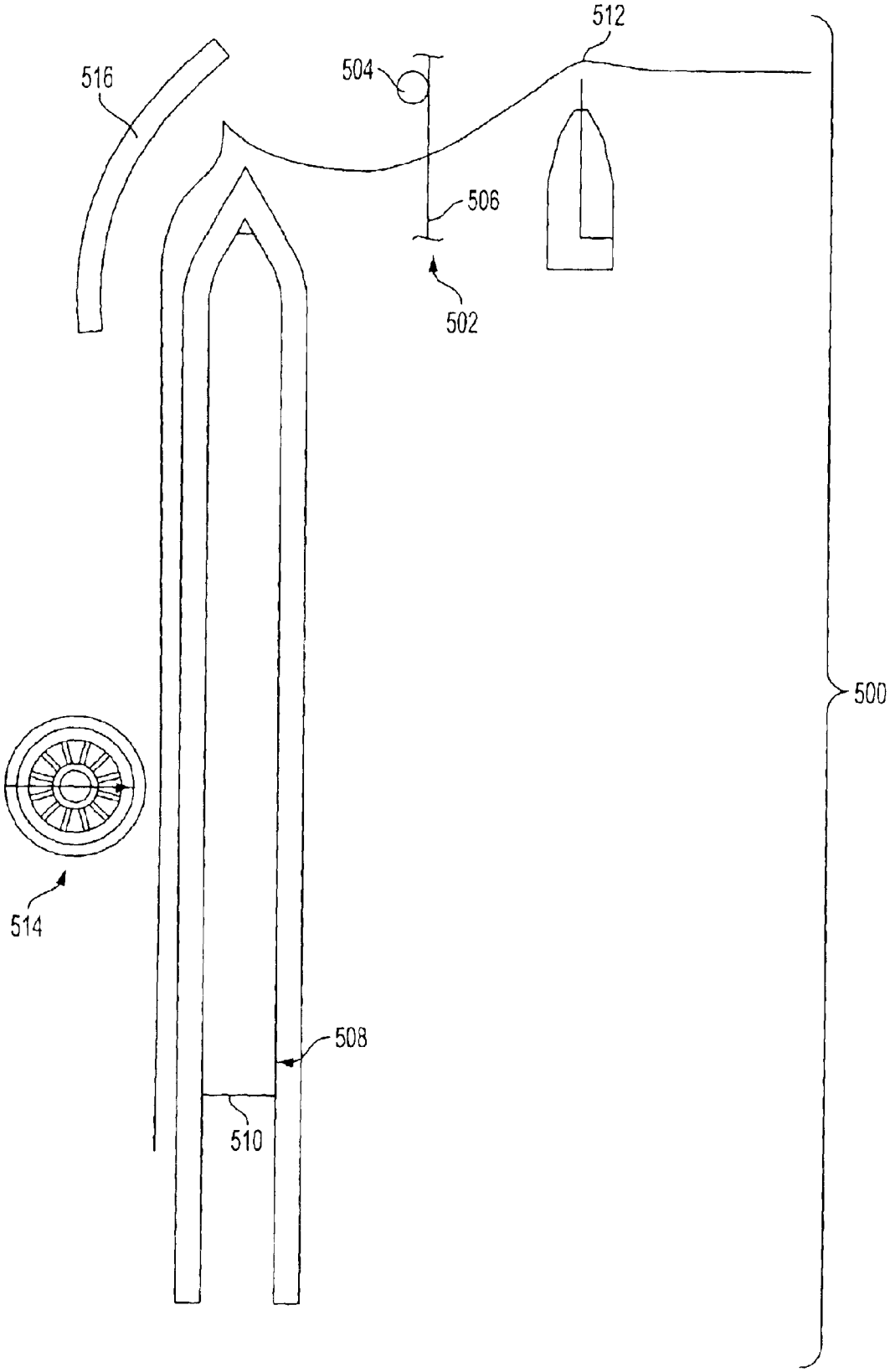
FIG. 5 shows an exemplary embodiment of an apparatus for stacking folded paper sheets during a sheet collecting operation showing the first sheet contacting element as a sweep element.

FIG. 5 shows an exemplary embodiment of an apparatus 500 for stacking folded paper sheets during a sheet collecting operation showing a first sheet drive assembly 502 including a first sheet contacting component 504, such as at least one sweep element fixed to a moving element 506. The moving element 506 is operably connected to a first drive mechanism to be translatable in a direction approximately parallel to the first side 508 of the collecting device 510. Suitable sweep elements can include a bar, a rod, an elongated finger, and so forth including any linear, non-linear, or curvilinear protrusion than can contact the folded paper sheet 512 and drag across the surface of the folded paper sheet 512 while the moving element 510 is translated by the first drive mechanism. The moving element 510 can be any suitable device providing the necessary movement of the first sheet contacting component 504 from the sheet receiving position to the sheet discharging position. For example, the moving element 510 can be an endless loop device or translational device such as a belt, a chain, a gear rack coupled to a drive motor, where the drive motor is a dc synchronous motor or a stepper motor, or any other suitable endless loop device or translational device. The second sheet drive assembly 512 and/or the redirecting element 514 can be of any suitable form, such as the second sheet drive assembly and the redirecting element shown and described with reference to FIGS. 1, 2, and 4.

Figure 6:
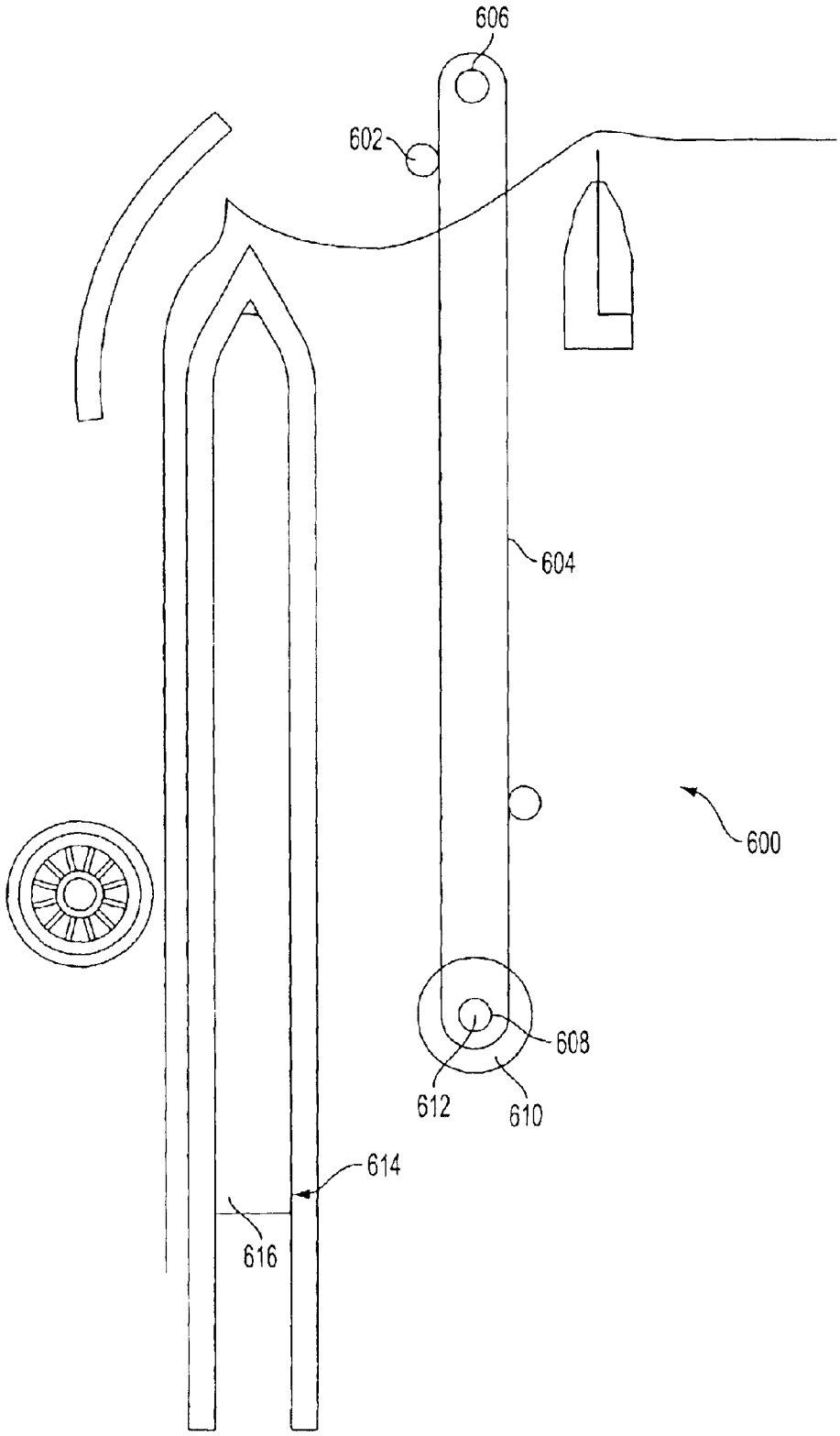
FIG. 6 shows the exemplary embodiment of FIG. 5 with the sweep element is mounted on an endless belt.

FIG. 6 shows an exemplary embodiment of the FIG. 5 apparatus in which the first sheet drive assembly 600 includes a first sheet contacting component 602 mounted on a endless belt 604. The endless belt 604 operates between two pulleys 606, 608. One of the pulleys 608 has a first drive mechanism 610 operably connected to its axis of rotation 612.

The first sheet drive assembly 600 can be located on the collecting device side of the paper path and can operate to move the sheet contacting component, e.g., a sweep element, from a sheet receiving position, across the paper path from the collecting device, to a sheet discharging position. The sheet receiving position and the sheet discharging position are substantially within a plane parallel to and offset from the first side 614 of the collecting device 616. The sheet receiving position is located a first distance from the first side and the sheet discharging position is located a second distance from the first side. In an exemplary embodiment, the sheet receiving position and the sheet discharging position have a planar relationship and the second distance is less than the first distance.

The first sheet drive assembly can have one or more sweep elements can be positioned on the endless loop. For example, a first sweep element can be positioned on the endless loop such that it is above the paper path during the feeding of a folded paper sheet into the apparatus. A second sweep element can be at the same time positioned such that it is below the paper path during the feeding operation. In other words, when more than one sweep element is included, the separation between any two sweep elements on the moving element should be sufficient to ensure that when one sweep element is in the sheet receiving position one sweep element is in the sheet discharging position. Thus, during the movement of the endless loop, the first sweep element moves from the sheet receiving position to the sheet discharging position such that a trailing portion of the folded sheet is dragged into the apparatus and reoriented parallel to the first side of the collecting device. Simultaneously, the second sweep element is being positioned above the paper path to repeat the operation on subsequent trailing portions of folding sheets. The sweep elements can be positioned on the endless loop by any suitable means such as by adhesive, by mechanical connection such as threaded or blind connections, by crimping, and so forth.

Figure 7:
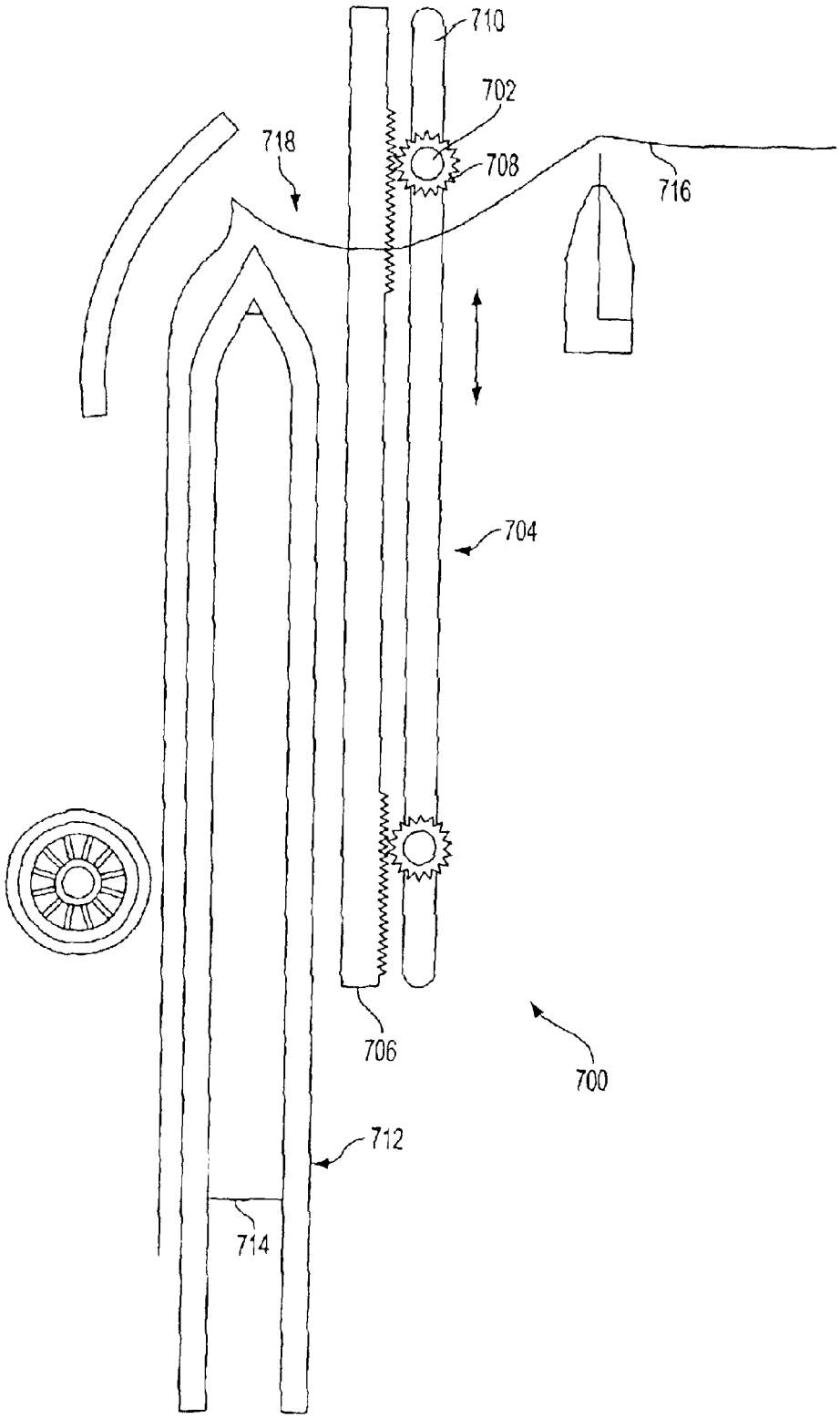
FIG. 7 shows the exemplary embodiment of FIG. 5 with the sweep element is mounted on a translational device.

As shown in the exemplary embodiment of FIG. 7, a first sheet drive assembly 700 includes a first sheet contacting element 702 can be mounted on a translational device 704. The translational device 704 can include a fixed gear rack 706 operatively connected to a motor and gear 708 on a translatable shaft 710. The sweep element 702 is mounted on the translatable shaft 710. In the FIG. 7 embodiment, the sweep element 702 is mounted coaxially with the motor and gear 708, but any suitable mounting location can be used. During operation, the translatable shaft 710 moves substantially parallel to the first side 712 of the collecting device 714 and the sweep element 702 moves from a sheet receiving position above the paper path through the paper path to the sheet discharging position, thereby contacting the trailing portion 716 of the folded paper sheet 718 and positioning the trailing portion 716 onto the first side 712 of the collecting device 714. After a single operation of the translation device, the translatable shaft 710 is repositioned along the gear rack 706 to place the sweep element 702 above the paper path to receive subsequent folded paper sheets.

The apparatus for stacking a folded paper sheet during a sheet stacking operation can be integrated into a booklet making system. In an exemplary embodiment, the apparatus for stacking folded paper sheets during a sheet collecting operation is a component in a booklet maker system. For example, a booklet making system can include a paper path, a paper folding apparatus, and an apparatus for stacking a folded paper sheet during a sheet collecting operation. The apparatus for stacking a folded paper sheet during a sheet collecting operation can have a collecting device having a first side and second side, a first sheet drive assembly including a first sheet contacting component, and a second sheet drive assembly including a second sheet contacting component. The collecting device is stationary with respect to at least one of the paper path, the first sheet contacting component and the second sheet contacting component during a sheet collecting operation. The first sheet drive assembly is located on the first side of the collecting device and is operable to move between a sheet receiving position located a first distance from the first side and a sheet discharging position located a second distance from the first side. The second sheet drive assembly includes a second sheet contacting component and is located on the second side of the collecting device. The second sheet contacting component can translate to pinch the sheet on the second side of the collecting device.

An exemplary booklet making system can comprise a binding apparatus for stack folded sheets. The binding apparatus can be selected from the group consisting of a stapling unit, a saddle-stitch unit (e.g., wire, staple, and so forth), a cover application unit, a saddle-sewing unit (e.g., using thread), and an adhesive unit. For example, and as shown in FIG. 2, a booklet making system 224 can include a binding apparatus 226 located proximate to the collecting device 202 of the folded paper sheet handling apparatus at the point at which the fold in the folded paper sheet rests in the final position. In an example where the binding apparatus is a stapling unit, the binding apparatus can contact the stacked folded sheets on the collecting device and perform a stapling operation to secure the multiple folded sheets one to the other to form an assembled booklet. Similar binding operations on stacked folded sheets can be performed by the other binding apparatus.

A folded paper sheet handling apparatus can handle and stack folded paper sheets to form an assembled booklet. In an exemplary embodiment, a folded paper sheet handling apparatus includes a collecting device having a first side and a second side, means for guiding a folded sheet from a paper path to the collecting device such that a leading portion of the folded sheet is positioned on the collecting device, means for moving a folded sheet along at least one of the first side and the second side of the collecting device, and means for positioning a trailing edge portion of the folded sheet on the collecting device. The collecting device is stationary with respect to the paper path during a sheet collecting operation.

Means for guiding a folded paper sheet can be any suitable means. For example, an exemplary embodiment of means for guiding a folded sheet includes a first sheet drive assembly, a paper drive, a paper handling receiving assembly, or any other suitable means for guiding a folded sheet or combinations thereof. Likewise, means for moving a folded sheet along at least one of the first side and the second side of the collecting device can be any suitable means for moving. In an exemplary embodiment, means for moving a folded sheet is a first sheet drive assembly, a second sheet drive assembly, a paper drive or combinations thereof. Means for moving a folded sheet can also include any suitable driven element such as a tire, a roller, a paddle drive, or any other translation or rotational device. Means for positioning a trailing edge portion of the folded sheet on the collecting device can be any suitable means. For example, an exemplary embodiment, means for positioning can be a first sheet drive assembly operable to move between a sheet receiving position and a sheet discharging position, a paper handling entrance assembly, a sweep element moving from a sheet receiving position to a sheet discharging position, or other suitable driven and translational means or combinations thereof.

An exemplary method for handling folded paper sheets includes guiding a first portion of a folded paper sheet to a first side of a collecting device along a paper path which includes a first sheet contacting component of a first sheet drive assembly, contacting the first portion of the folded paper sheet with a second sheet contacting component of a second sheet drive assembly, contacting a second portion of the folded paper sheet with the first sheet contacting component of the first sheet drive assembly, rotating or translating at least one of the first sheet contacting component and the second sheet contacting component in a sheet advancing direction to advance the first portion of the folded paper sheet along the first side of the collecting device, repositioning the first sheet drive assembly to guide the second portion of the folded paper sheet to a second side of the collecting device, and rotating or translating at least one of the first sheet contacting component and the second sheet contacting component in a sheet reversing direction to position the second portion of the folded paper sheet along the second side of the collecting device.

In an exemplary embodiment, the first portion of the folded paper sheet is separated from the second portion of the folded paper sheet by a fold portion. In the exemplary method, the portion of the folded paper sheet contacted by the first sheet contacting component is not the portion of the folded paper sheet contacted by the second sheet contacting component. For example, where the first sheet contacting component contacts the leading portion of the folded paper sheet, the second sheet contacting component contacts the trailing portion of the folded paper sheet. Likewise, where the second sheet contacting component contacts the leading portion of the folded paper sheet, the first sheet contacting component contacts the trailing portion of the folded paper sheet.

Further, in an exemplary method, at least one of the first sheet contacting component and the second sheet contacting component in the step of contacting holds the contacted portion of the folded paper sheet stationary.

An exemplary method includes placing the folded paper sheet on the collecting device in a final position. The step of placing the folded paper sheet on the collecting device in a final position can include moving the first sheet drive assembly to release the contacted portion of the folded paper sheet. For example, the first sheet drive assembly can be moved perpendicular to the paper path, transverse to the paper path or a combination thereof by suitable means, such as driven or translational means or combinations thereof. The final position of the folded paper sheet on the collecting device can include the first portion on the first side, the second portion on the second side, and the fold portion of the folded paper sheet on an edge of the collecting device. The edge of the collecting device has a peak adapted to receive the fold portion. Alternatively, the final position of the folded paper sheet on the collecting device includes the second portion on the first side, the first portion on the second side, and a fold portion of the folded paper sheet on an edge of the collecting device.

In an exemplary method, the first portion of the folded paper sheet is a leading portion of the folded paper sheet. The leading portion is positioned between the second sheet contacting component and the second side of the collecting device during the step of guiding the leading portion of the folded paper sheet from the paper path to the collecting device or during the step of contacting the first portion of the folded paper sheet with a second sheet contacting component. Contacting the second portion of the folded paper sheet can include positioning the first sheet drive assembly along an edge or surface of the second portion of the folded paper sheet. The second sheet contacting component can apply a force against the first side of the collecting device during the step of contacting the first portion of the folded paper sheet. The leading portion of the folded paper sheet is advanced along the first side of the collecting device no further than a point where a fold in the folded paper sheet meets the second sheet drive assembly and the fold is not passed between the second sheet contacting component and the collecting device. Repositioning the first sheet drive assembly does not release the second portion of the folded paper sheet from being in contact with the first sheet contacting element.

In an exemplary method, the first sheet contacting component is a driven rotatable element and the second portion of the folded paper sheet is a leading portion which is captured between the driven rotatable element and an opposing sheet contacting component during the step of contacting the second portion of the folded paper sheet with a second sheet contacting component. Contacting the first portion of the folded paper sheet can include positioning the second sheet drive assembly along an edge or surface of a trailing portion of the folded paper sheet. The second sheet contacting component can apply a force against the first side of the collecting device during the step of contacting the first portion of the folded paper sheet. The second portion of the folded paper sheet can be advanced between the driven rotatable element and an opposing sheet contacting component during the step of rotating or translating. The second portion of the folded paper sheet is advanced no further than a point where a fold in the folded paper sheet meets the first sheet drive assembly and the fold is not passed between the driven rotatable element and an opposing sheet contacting component. Repositioning the first sheet drive assembly does not release the first portion of the folded paper sheet from being in contact with the first sheet contacting element.

In an exemplary method, the collecting device is stationary with respect to at least one of the paper path, the first sheet drive assembly and the second sheet drive assembly. Further, the collecting device can be oriented perpendicular or parallel to an orientation of the folded paper sheet at a point in the paper path upstream of the step of guiding.

An exemplary method for handling folded paper sheets can be described in reference to the apparatus for stacking folded paper sheet during a sheet collecting operation. FIGS. 8*a*–8*i* show sequential views of the apparatus of FIG. 2 during stacking of a folded paper sheet in an exemplary sheet collecting operation. In the exemplary method, the apparatus 800 is placed in a ready mode to receive an incoming sheet, for example, to receive an incoming sheet from a fold apparatus 802 (FIG. 8*a*).

An upstream paper advance system (not shown) drives the next sheet into the apparatus 800 after completion of a previous folded sheet operation, such as a folding operation. The folded paper sheet 804 enters the apparatus 800 and a leading portion 806 of the folded paper sheet 804 is guided from the paper path to a second side 808 of the collecting device 810 by the first sheet drive assembly 812, shown in FIG. 8*b* in a sheet receiving position. The leading portion 806 of the folded paper sheet 804 travels through a gap 814 between the first sheet contacting component 816, e.g., the driven rotatable element, and the freely rotatable element 818 of the first sheet drive assembly 812. The leading portion 806 of the folded paper sheet 804 passes through the gap 804 and over the collecting device 810 to the second side 808. The leading portion 806 of the folded paper sheet 804 is then redirected by the stationary redirecting element 820, shown substantially as a guide chute in FIG. 8*b*. The redirecting element 820 redirects the paper down along the second side 808 of the collecting device 810 and toward the second sheet drive assembly 822, shown substantially as a driven tire offset from the second side 808 of the collecting device 810. The upper stream paper advance system (not shown) continues to drive the paper folded sheet 804 into the apparatus 800. Thus, the leading portion 806 of the folded paper sheet 804 continues to advance between the second sheet drive assembly 822 and the second side 808 of the collecting device 810, e.g., the second sheet contacting component 824 and the second side 808.

The fold 826 in the folded paper sheet 804 passes through the gap 814 in the first sheet drive assembly 812 without any deleterious affects on the fold 826. For example, the fold 824 is maintained crisp and sharp and is not damaged, as it would be if it went through a pinch drive. This step is illustrated in FIG. 8*c*.

The second sheet contacting component 824 of the second sheet drive assembly 822 translates to contact the leading portion 806 of the folded paper sheet 804 on the second side 808 of the collecting device 810. FIG. 8*d* shows the second sheet contacting component 824 contacting the leading portion 806 of the folded paper sheet 804 and holding the leading portion 806 of the folded paper sheet 804 stationary with respect to the collecting device 810.

Likewise, the first sheet drive assembly 812 operates to hold the trailing portion 828 of the folded paper sheet 804 stationary with respect to the first sheet contacting component 816 by, for example, the freely rotatable element 818 translating to an engaged position to apply force to the first sheet contacting component 816, e.g., a driven rotatable element. The force can pinch, hold, press and so forth the folded paper sheet 804 within the first sheet drive assembly 812. In the FIG. 8*d* example, the freely rotatable element 818 is mounted eccentrically on the housing 830, such as a cam, and the freely rotatable element 818 translates to the engaged position, e.g., is drawn inwards to apply force to the first sheet contacting component, during movement of the housing 830, e.g. during rotation or pivoting of the housing 830.

A coordinated driving motion between the first sheet drive assembly 812 and the second sheet drive assembly 822 (shown in FIG. 8*e*) moves the folded paper sheet 804 in the sheet advancing direction 832 down the second side 808 of the collecting device 810. For example, the first sheet drive assembly 812 and the second sheet drive assembly 822 can rotate in a coordinated fashion to advance the leading portion 806 of the folded paper sheet 804 down the second side 808 of the collecting device 810. During this operation, the leading portion 806 of the folded paper sheet 804 is advanced no further than a point where the fold 826 in the folded paper sheet 804 meets the second sheet drive assembly 822. For example, the fold 826 in the folded paper sheet 804 is not passed between the second sheet drive assembly 822 and the second side 808 of the collecting device 810. Therefore, the fold 826 in the folded paper sheet 804 is preserved. During this operation, at least a portion of the trailing edge 828 of the folded paper sheet 804 advances on to the second side 808 of the collecting device 810. Further, the end 834 of the trailing portion 828 of the folded paper sheet 804 is substantially brought into the apparatus 800. The leading edge 806 of the folded paper sheet 804 can be allowed to curl back under the collecting device 810 of the apparatus 800.

In FIG. 8*f*, the first sheet drive assembly 812 moves to a sheet discharging position. As shown in the exemplary embodiment of FIG. 8*f*, the moving of the first sheet drive assembly 812 to the sheet discharging position redirects the end 834 of the trailing portion 828 of the folded paper sheet 804 to be oriented to run along the first side 836 of the collecting device 810. For example, the first sheet drive assembly 812 can pivot 90° to direct the end 834 of the trailing portion 828 of the folded paper sheet 804 downward. Thus, the first sheet drive assembly 812 is repositioned to guide the trailing portion 828 of the folded paper sheet 804 along a first side 836 of the collecting device 810.

At least one of the first sheet contacting component 816 and the second sheet contacting element component 824 rotate in a sheet reversing direction 838 to position the trailing portion 828 of the folded paper sheet 804 along the first side 86 of the collecting device 810. FIG. 8*g* shows an example of positioning the trailing portion 828 of the folded paper sheet 804 along the first side 836 of the collecting device 810.

The folded paper sheet 804 is then placed on the collecting device 810 in the final position. For example, as shown in FIG. 8*h*, the freely rotatable element 818 of the first sheet drive assembly 812 can translate to disengage from the first sheet contacting component 816 and to thereby disengage from contacting the folded paper sheet 804. The first sheet drive assembly 812 can then move to release the trailing portion 828 of the folded paper sheet 804 and to place the folded paper sheet 804 in the final position on the collecting device 810. For example, the first sheet drive assembly 812 can be operably connected to a translation system for moving the first sheet drive assembly 812 out of the paper path. e.g., either perpendicular to or parallel and transverse to the folded paper sheet. As shown in FIG. 8*h*, the first sheet drive assembly 812 includes a portion which moves out of the plane of the figure at one end, and which moves into the plane of the figure to allow the sheet to fall and lay on the first side of the saddle in FIG. 8*i* (see FIG. 1 regarding the use of a first sheet drive assembly at each end of the collecting device). During this operation, the second sheet drive assembly 822 continues to hold the leading portion 806 of the folded paper sheet 804 against the collecting device 810.

As shown in FIG. 8*i*, subsequent to the release of the trailing portion 828 of the folded paper sheet 804 by the first sheet drive assembly 812, the second sheet drive assembly 822 translates perpendicularly away from the second side 808 of the collecting device 810. Accordingly, the folded paper sheet 804 moves to the final position on the collecting device 810. Further, the first sheet drive assembly 812 repositions to the sheet receiving position.

In the final position shown in the exemplary method of FIG. 8*i*, the leading portion 806 of the folded sheet 804 is on the second side 808 of the collecting device 810, the trailing portion 828 of the folded sheet 804 is on the first side 836 of the collecting device 810, and a fold 826 of the folded sheet 804 is on the edge 840 of the collecting device 810.

During the operation of FIGS. 8*a* to 8*i*, the collecting device has remained stationary with respect to at least one of the paper path, the first paper drive assembly, or the second paper drive assembly.

FIGS. 9*a*–9*j* show sequential views of the apparatus 900 of FIG. 4 during stacking of a folded paper sheet in an exemplary sheet collecting operation. In the exemplary method, the apparatus 900 is placed in a ready mode to receive an incoming sheet, for example, to receive an incoming paper sheet from an upstream paper advance system. In the exemplary method, an unfolded paper sheet is shown, however, both a folded paper sheet and an unfolded paper sheet can be used.

FIG. 9*a* shows a paper sheet 902 being fed from a main paper drive 904 over a fold blade 906 into the apparatus 900 through the slot 908 in the paper handling entrance assembly 910. The paper sheet 902, enters the apparatus 900 and a leading portion 912 is guided from the paper path to a second side 914 of the collecting device 916 and into the first sheet drive assembly 918.

In the exemplary embodiment shown in FIG. 9*a*, the first sheet drive assembly 918 includes a driven rotatable element 920 and an opposing sheet contacting component 922. In the sheet receiving position, there is a gap 924 between the driven rotatable element 920 and the opposing sheet contacting component 922. Guide elements 926 associated with each of the driven rotatable element 920 and an opposing sheet contacting component 922 help to guide the leading portion 912 of the paper sheet 902 into the gap 924.

The first sheet drive assembly 918 then operates to capture the leading portion 912 of the paper sheet 902. For example and as shown in FIG. 9*b*, the driven rotatable element 920 can translate to an engaged position to apply force to the opposing sheet contacting component 922, thereby pinching the leading portion 912 of the paper sheet 902 within the first sheet drive assembly 918.

The first sheet drive assembly 918 can translate parallel to the second side 914 of the collecting device 916 from a first position (Position A) to a second position , e.g. from a sheet receiving position to a second position such as Position B in FIG. 9*e*. FIG. 9*c* through FIG. 9*e* show the translation of the first sheet drive assembly 918. The translation of the second paper drive assembly 918 can be coordinated with the operation of the main paper drive 904 to advance the paper sheet 902 along the collecting device 916.

The paper sheet 902 could have been previously provided with a fold 928 separating it into leading portion 912 and trailing portion 930. Or, the operation of the translation of the first sheet drive assembly 918 can be coordinated with a folding step. For example, and as shown in FIG. 9*d*, the translation of the first paper drive assembly 918 can be paused between Position A and a second position, such as Position B, leaving a mid-portion of the paper sheet 902 over the fold blade 906 of a fold device. The fold 928 can be created, and the translation of the first paper drive assembly 918 resumed.

Subsequent to the translation to the second position, the first paper drive assembly 918 operates to rotate the driven rotatable element 920 to advance the folded paper sheet 902 into the apparatus 900. For example and as shown in FIG. 9*f*, the driven rotatable element 920 can rotate to advance the leading portion 912 of the folded paper sheet 902 along the second side 914 of the collecting device 916. The leading portion 912 can be allowed to curl back under the collecting device 916. The fold 928 in the folded paper sheet 902 is advanced no further than a point where the fold 928 meets the first sheet contacting component, e.g. the driven rotatable element 920, and the fold 928 does not pass between the driven rotatable element 920 and opposing sheet contacting component 922. By limiting the advance of the folded paper sheet 902 to prevent the fold 928 from entering the contacting portion of the first paper drive assembly 918, the fold 928 in the folded paper sheet 902 is maintained. Further, the advancing of the folded paper sheet 902 advances the end 932 of the folded paper sheet 902 through the slot 908 in the paper handling entrance assembly 910, such that the folded paper sheet 902 is contained completely within the apparatus 900.

Subsequently, the first paper drive assembly 918 is operated in reverse, as shown in FIG. 9*g*. For example, the first paper drive assembly 918 translates parallel to the second side 914 from the second position (Position B) to a third position (Position C). Position C can be the same position as the sheet receiving position (Position A in FIG. 9*c*), or can be a different position. During the translation from the second position to the third position, the driven rotatable element 920 rotates in the opposite direction to reverse the folded paper sheet 902 along the paper path. However, the slot 908 in the paper handling entrance assembly 910 is oriented such that the trailing portion 930 of the folded paper sheet 902 does not reenter the slot 908, but rather is directed to the first side 934 of the collecting device 916. For example, the paper handling entrance assembly 910 redirects, for example by 90°, the trailing portion 930 of the folded paper sheet 902 to be moved along the first side 934 of the collecting device 916 during the translation and reverse rotation of the first paper drive assembly 918.

A second paper drive assembly 936 is positioned on the first side 934 of the collecting device 916. The second paper drive assembly 936 is shown in a sheet receiving position in FIG. 9*f* and a sheet contacting position in FIG. 9*g*. In the sheet receiving position, the trailing portion 930 of the folded paper sheet 902 is guided between the second paper drive assembly 936 and the first side 934 of the collecting device 916. Subsequently, the second paper drive assembly 936 operates to move the trailing portion 930 of the folded paper sheet 902 down the first side 934 of the collecting device 916. For example, the second paper drive assembly 936 can have a second sheet contacting component 938, such as the curvilinear flapper bar shown in FIGS. 9*a*–9*j*, which rotates from a sheet receiving position to a sheet contacting position and can continue to rotate while contacting the paper sheet 902, thereby moving the paper sheet 902 down the first side of the collecting device 916.

Concurrent to the placing of the trailing portion 930 of the folded paper sheet 902 into the second paper drive assembly 936, a second paper sheet 940 can be fed into the slot 908 of the paper handling entrance assembly 910. The leading portion 942 of the second paper sheet 940 advances to the second side 914 of the collecting device 916 on an outer surface 944 of the first folded paper sheet 902, e.g., on the surface of the first folded paper sheet 902 away from the collecting device 916. The apparatus 900 now manipulates or handles two paper sheets concurrently. Thus, the throughput of folded paper sheets could be increased by the simultaneous operation of reversing the direction of the first folded paper sheet 902 and feeding a second paper sheet 940 into the apparatus 900.

FIG. 9*h* shows the first paper drive assembly 918 releasing the first folded sheet 902. The releasing of the first folded paper sheet 902 can be by any suitable method. For example, the driven rotatable element 920 and opposing sheet contacting component 922 of the first paper drive assembly 918 can disengage and the first paper drive assembly 918 can translate parallel to and/or transverse to the paper path. Alternately, the first sheet drive assembly 918 can be translated to the second position, e.g., Position B or other suitable position, while not engaging the folded paper sheet 902, thereby releasing the folded paper sheet 902 from the first paper drive assembly 918. Concurrently, the second sheet drive assembly 936 can complete the positioning of the folded paper sheet 902 on the first side 934 of the collecting device 916 and returns to the sheet receiving position.

The first sheet drive assembly 918 can translate back to the first position (Position A) and the guiding elements 926 can guide the leading portion 942 of the second paper sheet 942 between the driven rotatable element 920 and opposing sheet contacting component 922 (FIG. 9*i*). The driven rotatable element 920 and opposing sheet contacting component 922 operate together to pinch the leading portion 942 of the second paper sheet 940 (FIG. 9*j*), and the operations shown and described with respect to FIGS. 9*a* to 9*h* can be repeated for subsequent folded paper sheets.

Any number of folded paper sheets can be stacked by the repetition of this method. After all the sheets have been stacked, subsequent booklet making operations can be conducted, such as binding operations, and so forth. When the booklet is assembled, the paper handling chutes of the paper handling entrance assembly pivot about their pivot points and the assembled booklet can be ejected from the collecting device.

During the operation of FIGS. 9*a* to 9*j*, the collecting device has remained stationary with respect to at least one of the paper path, the first paper drive assembly, or the second paper drive assembly.

Another exemplary method for handling folded sheets includes guiding a leading portion of a first folded paper sheet to a second side of a collecting device, guiding the leading portion of the first folded paper sheet between a second sheet contacting component and the second side of the collecting device, positioning a fold in the first folded paper sheet over an edge of the collecting device, moving the second sheet contacting component to apply a force against the second side of the collecting device to hold the leading portion of the first folded paper sheet stationary, and sweeping at least one sweep element from a first position on a first side of a paper path, through the paper path, to a second position so as to position a trailing portion of the first folded sheet along the first side of the collecting device.

Figure 10:
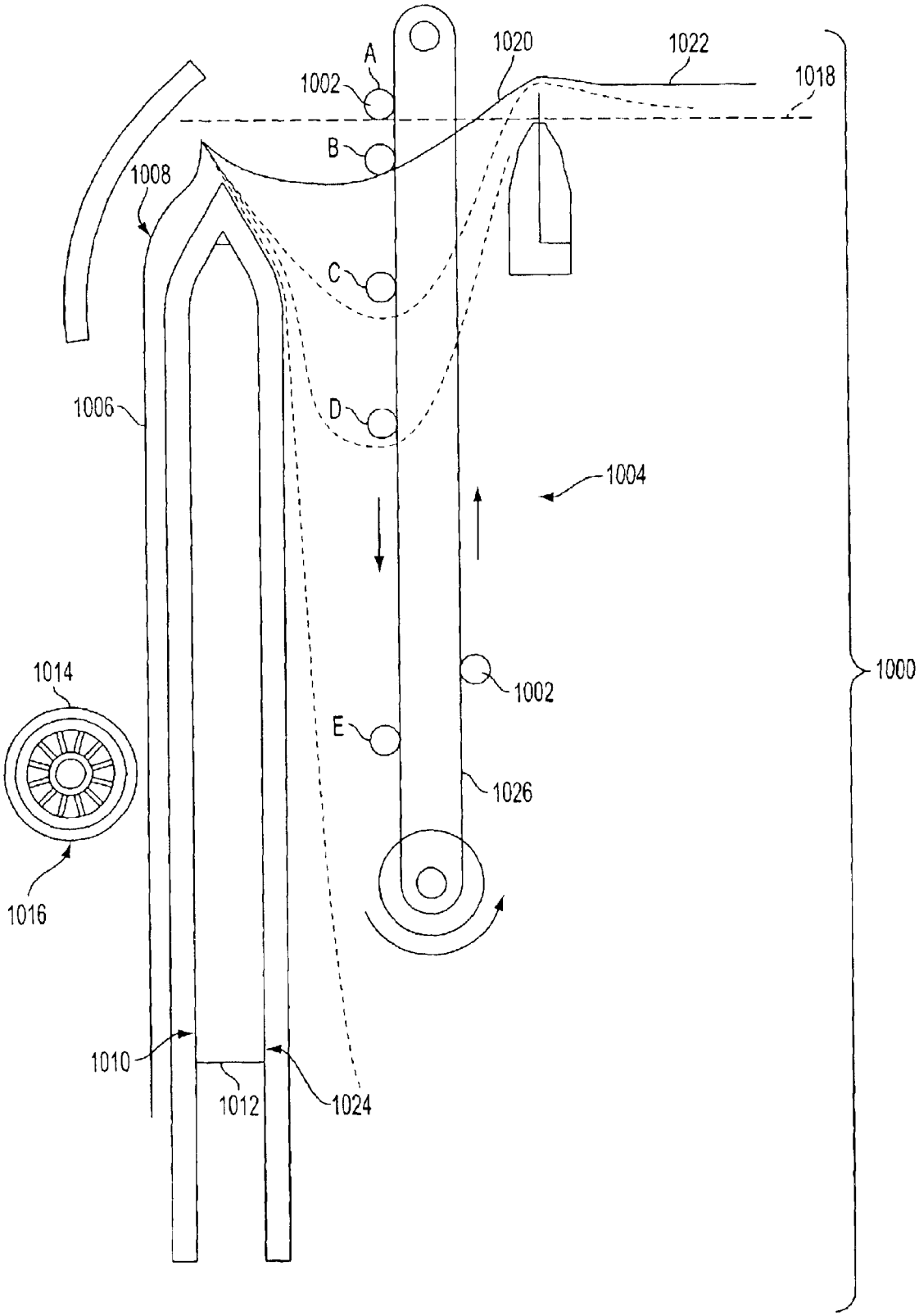
FIG. 10 show sequential side views of the apparatus of FIG. 6 during stacking of folded paper sheet in an exemplary sheet collecting operation.

FIG. 10 shows the position of the sweep element 1002 of a first sheet drive assembly 1004 during a method for handling folded sheets using the exemplary apparatus 1000 of FIG. 6. As shown in FIG. 10, a leading portion 1006 of the folded paper sheet 1008 has been guided to the second side 1010 of the collecting device 1012 and the sheet contacting component 1014 of the sheet drive assembly 1016 has contacted the leading portion 1006 of the folded paper sheet 1008 to hold the leading portion 1006 stationary with respect to the collecting device 1012.

In a sheet receiving position (Position A), the sweep element 1002 is on the first side 1018 of the paper path, which is on an opposite side of the paper path from the collecting device 1012. Subsequently, the sweep element 1002 moves through the paper path to a sheet contacting position (Positions B to D) and to a sheet discharging position (Position E). The sheet discharging position is below the original paper path of the folded paper sheet 1008. During the sweeping movement, the sweep element 1002 contacts the trailing portion 1020 of the folded paper sheet 1008 and completes the movement of the end 1022 of the folded paper sheet 1008 into the apparatus 1000 and positions the trailing portion 1020 of the folded paper sheet 1008 along the first side 1024 of the collecting device 1012. Multiple sweep elements or a single sweep element can be used. FIG. 10 shows multiple sweep elements 1002. The sweep elements 1002 can be affixed to any suitable moving element 1026, such as an endless belt or a translational device, for repositioning the sweep elements 1002.

Subsequent to the positioning of the trailing portion 1020 of a first folded paper sheet 1008 along the first side 1024 of the collecting device 1012, the sheet contacting component 1014 of the second sheet drive assembly 1016 moves away from the second side 1010 of the collecting device 1012 to disengage the sheet contacting component 1014 from the leading portion 1006 of the first folded paper sheet 1008. The apparatus 1000 is now in a receiving position for a second or a subsequent folded paper sheet.

For example, a leading portion of a second folded paper sheet can be guided to the second side of the collecting device. The leading portion can be guided between the sheet contacting component and the second side of the collecting device. The fold in the second folded paper sheet can be positioned over the collecting device such that a position of the fold in the second folded paper sheet corresponds to the fold in the first folded paper sheet. The sheet contacting component is moved to apply a force against the second side of the collecting device to hold the leading portion of the second folded sheet stationary with respect to the collecting device. At least one sweep element is swept from the sheet receiving position to the sheet discharging position so as to position the trailing portion of the second folded paper sheet along the first edge of the collecting device. Repetition of the method for handling folded sheets can be used to continue to stack additional folded paper sheets on to the collecting device.

During the operation of FIG. 10, the collecting device has remained stationary with respect to at least one of the paper path, the first paper drive assembly, or the second paper drive assembly.

An apparatus for stacking a folded paper sheet during a sheet collecting operation can include a translation device, such as a translating drive system operatively connected to the first sheet drive assembly. The translating drive system moves the first sheet drive assembly into and out of the paper path. For example, the first sheet drive assembly has a first sheet contacting component which can contact the surface, the edge, or the edge of the surface of the folded paper sheet during a sheet handling operation. Subsequently, the first sheet drive assembly can be moved out of the paper path to allow a subsequent paper handling operation, e.g., another folded paper sheet to be stacked, another booklet making operation, or ejection of a completed booklet. In an exemplary embodiment, the first sheet drive assembly can be moved into and out of the paper path by any suitable means. For example, the first sheet drive assembly can be operatively connected, e.g., mounted or connected, to a translation device which moves the first sheet drive assembly perpendicular to the paper path, e.g., is normal to the surface of the folded paper sheet, or parallel and transverse to the paper path, e.g., away from the edge of the folded paper sheet.

Figure 11:
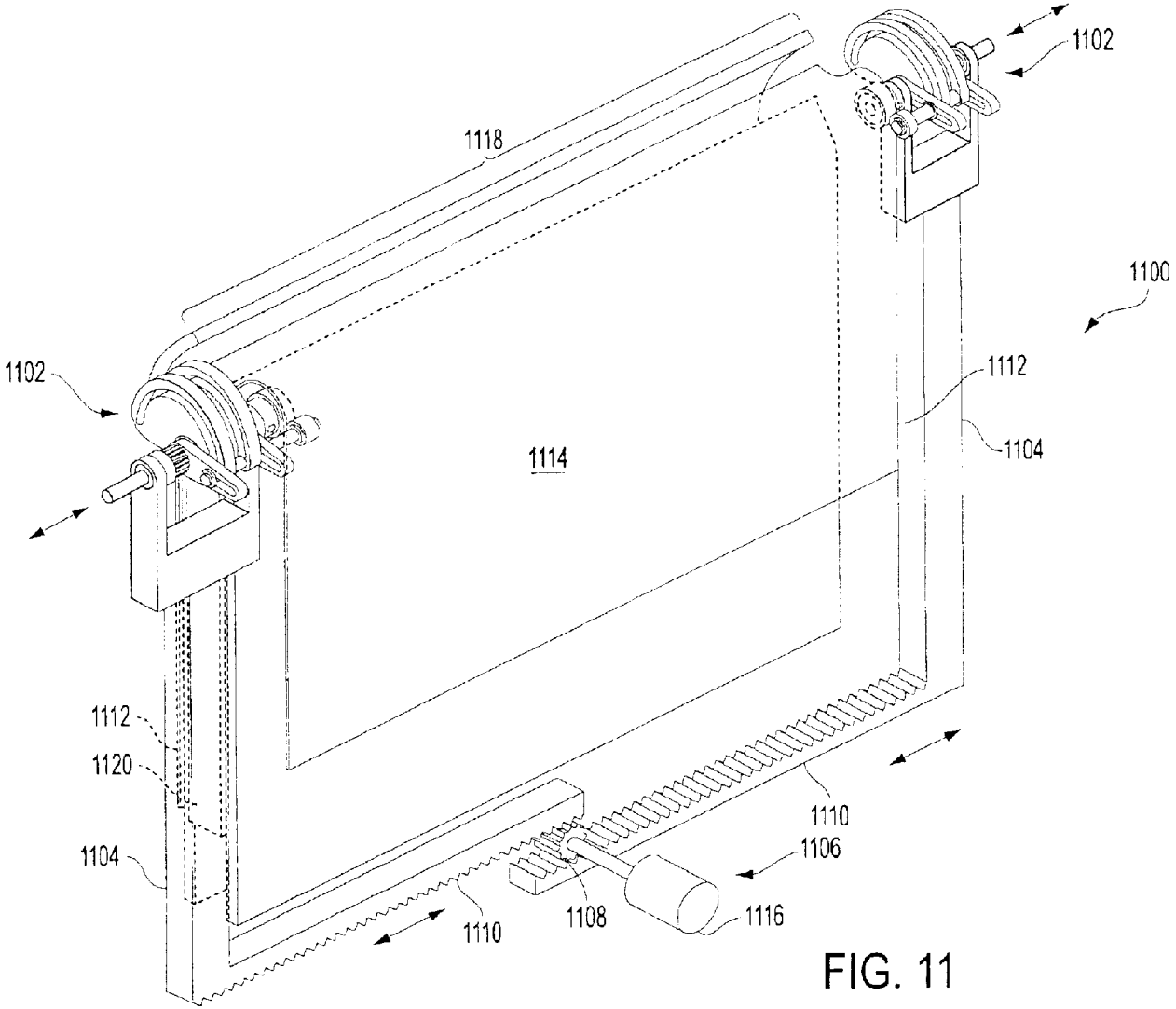
FIG. 11 shows an exemplary embodiment of an apparatus for stacking a folded paper sheet during a sheet collecting operation wherein the arms supporting the first sheet drive assemblies are at opposite ends of the a collecting device to accommodate different size sheets of paper and/or to accommodate the assembly of different size booklets.

FIG. 11 shows an exemplary embodiment of an apparatus for stacking folded paper sheet during a sheet collecting operation with a translation device 1100. The translational device 1100 is connected to the first sheet drive assemblies 1102 by connecting elements 1104 and has a linkage 1106, shown as a reciprocating gear 1108 and gear rack 1110. The translational device 1100 can translate the first sheet drive assemblies 1102 alternatively away from and into the edge 1112 of the folded paper sheet 1114. For example, a translational drive mechanism 1116, such as a DC motor, can drive the reciprocating gear 1108 and fear rack 1110 to manipulate the first sheet drive assemblies 1102. Alternatively, the translational movement of the first sheet drive assemblies 1102 can be coordinated by any suitable means, such as a controller operating independent translation devices, hydraulic couplings including interlocks, and so forth.

The translational device 1100 can adjust the position of the first sheet drive assemblies 1102 to accommodate any width of folded paper sheet 1114. Thus, for example, an 11×17 folded paper sheet, as shown in FIG. 11, can be used. FIG. 11 shows a collecting device which can accommodate any paper width which falls within a range of motion of the first sheet drive assemblies. The first paper drive assemblies 1102 can be translated by the translation device 1100 to accommodate any width size of folded paper sheet, for example, 4¾×9½ (e.g., an original nominal paper size).

Further, the connecting elements 1104 between the translational device 1100 and the first paper drive assemblies 1102 can be any form. As shown in FIG. 11, the connecting elements 1104 are C-ARM arrangements. The C-ARM arrangement allows for a open space 1118 on the sides of the collecting device 1120 between the first sheet drive assemblies 1102 and can prevent interference between the folded paper sheets 1114 from the translation device 1100. However, any suitable connecting elements can be utilized, including independent translation devices for each first paper drive assembly that can be coordinated by a control system, e.g., a central processing unit or a control program.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. An apparatus for stacking a folded paper sheet during a sheet collecting operation, the apparatus comprising:

a collecting device having a first side and a second side;

a first sheet drive assembly including a first sheet contacting component, the first sheet drive assembly located on the first side of the collecting device and operable to move between a sheet receiving position and a sheet discharging position; and a second sheet drive assembly including a second sheet contacting component, the second sheet drive assembly located on the second side of the collecting device and the second sheet contacting component translates to pinch the sheet on the second side of the collecting device, wherein the collecting device is stationary with respect to at least one of a paper path, the first sheet drive assembly and the second sheet drive assembly during a sheet collecting operation.

2. The apparatus of claim 1, comprising a stationary redirecting element having a first surface facing at least one of the first and second sides of the collecting device, the first surface offset a distance from the collecting device to define a folded paper channel.

3. The apparatus of claim 2, wherein the redirecting element deflects the paper path approximately ninety degrees.

4. The apparatus of claim 1, wherein the collecting device is saddle shaped.

5. The apparatus of claim 1 as a component in a booklet maker system.

6. The apparatus of claim 1, wherein the second sheet contacting element is a driven rotatable element operably connected to a second drive mechanism to rotate about an axis.

7. The apparatus of claim 1, wherein the second sheet contacting element translates perpendicular to the paper path to apply force to the second side.

8. The apparatus of claim 1, wherein the second sheet drive assembly comprises an opposing sheet contacting element and the second sheet contacting element translates perpendicular to the paper path to apply force to the opposing sheet contacting element.

9. The apparatus of claim 1, wherein the second sheet contacting element moves relative to the second side of the collecting device from an offset position, at which the leading portion of the folded sheet is guided to the second side of the collecting device, to a contact position, at which the trailing portion of the folded sheet is guided to the first side of the collecting device.

10. The apparatus of claim 1, wherein the first sheet contacting component is a driven rotatable element operably connected to a first drive mechanism to rotate the driven rotatable element.

11. The apparatus of claim 10, wherein the first sheet drive assembly comprises the driven rotatable element, a freely-rotatable element translatable to an engaged position to apply force to the driven rotatable element, and a housing pivoting about a pivot axis from the sheet receiving position to the sheet discharging position, wherein the freely-rotatable element and the driven rotatable element are mounted in the housing.

12. The apparatus of claim 11, wherein the driven rotatable element is mounted in the housing coaxial to the pivot axis.

13. The apparatus of claim 11, wherein the driven rotatable element and the freely rotatable element pivot on or about the pivot axis when the housing pivots.

14. The apparatus of claim 11, wherein the sheet receiving position is located a first distance from the first side and the sheet discharging position is located a second distance from the first side.

15. The apparatus of claim 14, wherein the first and second distances have a coaxial relationship.

16. The apparatus of claim 11, comprising a translating drive system operatively connected to the first sheet drive assembly for moving the first paper drive assembly into and out of the paper path.

17. The apparatus of claim 11, wherein the first sheet drive assembly in the sheet receiving position guides a leading portion of the folded sheet to the second side of the collecting device.

18. The apparatus of claim 11, wherein the first sheet drive assembly in the sheet discharging position guides the trailing portion of the folded sheet to the first side of the collecting device.

19. The apparatus of claim 11, comprising a plurality of first sheet drive assemblies on the first side of the collecting device.

20. The apparatus of claim 19, wherein one first sheet drive assembly on a first edge of the folded sheet is operatively connected via a linkage to move relative to one first sheet drive assembly on a second edge of the folded sheet.

21. The apparatus of claim 20, wherein the linkage comprises a gear rack and a gear operated by a translational drive mechanism.

22. The apparatus of claim 20, wherein the relative movement is away from the paper path.

23. The apparatus of claim 11, wherein the first sheet contacting component and the second sheet contacting component each contact an edge or a surface of the folded sheet to provide a motive force to move the folded sheet in an advancing direction or a reversing direction along the paper path.

24. The apparatus of claim 10, comprising a paper handling entrance assembly including a first paper handling chute and a second paper handling chute, the first paper handling chute spaced apart from the second paper handling chute to form a slot for receiving the folded paper sheet and for guiding the folded paper sheet to the first side of the collecting device.

25. The apparatus of claim 24, wherein the first paper handling chute and the second paper handling chute pivot away from each other, each having a pivot point distal from the slot.

26. The apparatus of claim 24, wherein the first sheet drive assembly comprises the driven rotatable element and an opposing sheet contacting component, the driven rotatable element translatable to an engaged position to apply force to the opposing sheet contacting component.

27. The apparatus of claim 26, wherein the opposing sheet contacting component is a freely-rotatable element.

28. The apparatus of claim 24, wherein the first sheet drive assembly is translatable parallel to the second side of the collecting device.

29. The apparatus of claim 24, wherein the second sheet drive assembly in the sheet receiving position has the second sheet contacting element spaced apart from the second side of the collecting device.

30. The apparatus of claim 24, wherein the second sheet drive assembly in the sheet discharging position rotates the second sheet contacting element to contact the trailing portion of the folded sheet to the second side of the collecting device.

31. The apparatus of claim 1, wherein the first sheet drive assembly comprises a moving element and the first sheet contacting component is at least one sweep element affixed to the moving element, the moving element operably connected to a first drive mechanism to be translatable in a direction approximately parallel to the first side of the collecting device.

32. The apparatus of claim 31, wherein the sweep element moves from the sheet receiving position across the paper path from the collecting device to the sheet discharging position substantially within a plane parallel to and offset from the first side of the collecting device.

33. The apparatus of claim 31, wherein the sheet receiving position is located a first distance from the first side and the sheet discharging position is located a second distance from the first side, the second distance less than the first distance.

34. The apparatus of claim 31, wherein the moving element is an endless loop device or a translational device.

35. The apparatus of claim 34, wherein the endless loop device is a belt or a chain.

36. The apparatus of claim 34, wherein the translational device is a gear rack coupled to a drive motor.

37. The apparatus of claim 36, wherein the drive motor is a DC synchronous motor or a stepper-motor.

38. The apparatus of claim 31, comprising a plurality of first sheet drive assemblies on the first side of the collecting device.

39. The apparatus of claim 31, wherein the first sheet drive assembly and the second sheet drive assembly each contact an edge or a surface of the folded sheet to provide a motive force to move the folded sheet in an advancing direction or a reversing direction along the paper path.

40. A booklet making system comprising:

a paper path;

a paper folding apparatus; and an apparatus for stacking a folded paper sheet during a sheet stacking operation, the apparatus including a collecting device having a first side and a second side, a first sheet drive assembly including a first sheet contacting component, the first sheet drive assembly located on the first side of the collecting device and operable to move between a sheet receiving position and a sheet discharging position, and a second sheet drive assembly located on the second side of the collecting device including a second sheet contacting component translatable to pinch the sheet on the second side of the collecting device, wherein the collecting device is stationary with respect to at least one of the paper path, the first sheet contacting component and the second sheet contacting component during a sheet collecting operation.

41. The booklet making system of claim 40, wherein the sheet receiving position is located a first distance from the first side and the sheet discharging position is located a second distance from the first side, the second distance less than the first distance.

42. The booklet making system of claim 40, comprising a binding apparatus for stacked folded sheets.

43. The booklet making system of claim 42, where the binding apparatus is selected from the group consisting of a stapling unit, a saddle-stitch unit, a cover application unit, and an adhesive unit.

44. A folded sheet handling apparatus, comprising:

a collecting device having a first side and a second side;

means for guiding a folded sheet from a paper path to the collecting device such that a leading portion of the folded sheet is positioned on the collecting device;

means for moving a folded sheet along at least one of the first side and the second side of the collecting device; and means for positioning a trailing edge portion of the folded sheet on the collecting device, wherein the collecting device is stationary with respect to the paper path during a sheet collecting operation.

45. A method for handling folded paper sheets, comprising:

guiding a first portion of a folded paper sheet to a first side of a collecting device along a paper path which includes a first sheet contacting component of a first sheet drive assembly;

contacting the first portion of the folded paper sheet with a second sheet contacting component of a second sheet drive assembly;

contacting a second portion of the folded paper sheet with the first sheet contacting component of the first sheet drive assembly;

rotating or translating at least one of the first sheet contacting component and the second sheet contacting component in a sheet advancing direction to advance the first portion of the folded paper sheet along the first side of the collecting device;

repositioning the first sheet drive assembly to guide the second portion of the folded paper sheet to a second side of the collecting device; and rotating or translating at least one of the first sheet contacting component and the second sheet contacting component in a sheet reversing direction to position the second portion of the folded paper sheet along the second side of the collecting device.

46. The method of claim 45, wherein the first portion of the folded paper sheet is separated from the second portion of the folded paper sheet a fold portion.

47. The method of claim 45, wherein at least one of the first sheet contacting component and the second sheet contacting component in the step of contacting holds the contacted portion of the folded paper sheet stationary.

48. The method of claim 45, comprising placing the folded paper sheet on the collecting device in a final position.

49. The method of claim 48, wherein the step of placing the folded paper sheet on the collecting device in a final position comprises moving the first sheet drive assembly to release the contacted portion of the folded paper sheet.

50. The method of claim 49, wherein the final position of the folded paper sheet on the collecting device includes the first portion on the first side, the second portion on the second side, and a fold portion of the folded paper sheet on an edge of the collecting device.

51. The method of claim 50, wherein the edge of the collecting device has a peak adapted to receive the fold portion.

52. The method of claim 49, wherein the final position of the folded paper sheet on the collecting device includes the first portion on the second side, the second on the first side, and a fold portion of the folded paper sheet on an edge of the collecting device.

53. The method of claim 52, wherein the edge of the collecting device has a peak adapted to receive the fold portion.

54. The method of claim 45, wherein the first portion of the folded paper sheet is a leading portion which is positioned between the second sheet contacting component and the first side of the collecting device during the step of guiding the first portion of the folded paper sheet to the first side of the collecting device along the paper path or during the step of contacting the first portion of the folded paper sheet with a second sheet contacting component.

55. The method of claim 54, wherein contacting the second portion of the folded paper sheet comprises positioning the first sheet drive assembly along an edge or surface of a trailing portion of the folded paper sheet.

56. The method of claim 54, wherein the second sheet contacting component applies a force against the first side of the collecting device during the step of contacting the first portion of the folded paper sheet.

57. The method of claim 54, wherein the first portion of the folded paper sheet is advanced along the first side of the collecting device no further than a point where a fold in the folded paper sheet meets the second sheet drive assembly and the fold is not passed between the second sheet contacting component and the collecting device.

58. The method of claim 54, wherein repositioning the first sheet drive assembly does not release the second portion of the folded paper sheet from being in contact with the first sheet contacting element.

59. The method of claim 45, wherein the collecting device is oriented perpendicular or parallel to an orientation of the folded paper sheet at a point in the paper path upstream of the step of guiding.

60. The method of claim 45, wherein the collecting device is stationary with respect to at least one of the paper path, the first sheet drive assembly and the second sheet drive assembly.

61. The method of claim 45, wherein the first sheet contacting component is a driven rotatable element and the second portion of the folded paper sheet is a leading portion which is captured between the driven rotatable element and an opposing sheet contacting component during the step of contacting the second portion of the folded paper sheet with a second sheet contacting component.

62. The method of claim 61, wherein contacting the first portion of the folded paper sheet comprises positioning the second sheet drive assembly along an edge or surface of a trailing portion of the folded paper sheet.

63. The method of claim 61, wherein the second sheet contacting component applies a force against the first side of the collecting device during the step of contacting the first portion of the folded paper sheet.

64. The method of claim 61, wherein the second portion of the folded paper sheet is advanced between the driven rotatable element and an opposing sheet contacting component during the step of rotating or translating no further than a point where a fold in the folded paper sheet meets the first sheet drive assembly and the fold is not passed between the driven rotatable element and an opposing sheet contacting component.

65. The method of claim 61, wherein repositioning the first sheet drive assembly does not release the first portion of the folded paper sheet from being in contact with the first sheet contacting element.

66. A method for handling folded paper sheets, comprising:

guiding a leading portion of a first folded paper sheet to a second side of a collecting device;

guiding the leading portion of the first folded paper sheet between a sheet contacting component and the second side of the collecting device;

positioning a fold in the first folded paper sheet over an edge of the collecting device;

moving the sheet contacting component to apply a force against the second side of the collecting device to hold the leading portion of the first folded paper sheet stationary; and sweeping at least one sweep element from a first position on a first side of a paper path, through the paper path, to a second position so as to position a trailing portion of the first folded sheet along the first side of the collecting device.

67. The method of claim 66, wherein the first side of the paper path is on an opposite side of the paper path from the collecting device.

68. The method of claim 66, comprising:

moving the sheet contacting component away from the second side of the collecting device to disengage the sheet contacting element from the leading portion of the first folded paper sheet;

guiding a leading portion of a second folded paper sheet to the second side of the collecting device;

guiding the leading portion of the second folded paper sheet between the sheet contacting component and the second side of the collecting device; and positioning a fold in the second folded paper sheet over the collecting device such that a position of the fold in the second folded paper sheet corresponds to the fold in the first folded paper sheet.

69. The method of claim 68, comprising:

moving the sheet contacting component to apply a force against the second side of the collecting device to hold the leading portion of the second folded paper sheet stationary; and sweeping at least one sweep element from the first position, through the paper path to the second position so as to position the trailing portion of the second folded paper sheet along the first side of the collecting device.

70. The method of claim 69, wherein the first side of the paper path is on an opposite side of the paper path from the collecting device.

* * * * *